US007015937B2

(12) United States Patent
Kamoshida et al.

(10) Patent No.: US 7,015,937 B2
(45) Date of Patent: Mar. 21, 2006

(54) ELECTROSTATIC LATENT IMAGE WRITING HEAD, METHOD OF MANUFACTURING THE SAME AND IMAGE FORMING APPARATUS INCORPORATING THE SAME

(75) Inventors: Shinichi Kamoshida, Nagano-ken (JP); Kiyoteru Katsuki, Nagano-ken (JP); Nobumasa Abe, Nagano (JP); Atsunori Kitazawa, Nagano (JP); Kiyoshi Tsujino, Nagano (JP); Yujiro Nomura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 95 days.

(21) Appl. No.: 10/648,795

(22) Filed: Aug. 27, 2003

(65) Prior Publication Data

US 2004/0207713 A1 Oct. 21, 2004

(30) Foreign Application Priority Data

Aug. 27, 2002 (JP) ..... P2002-246230
Aug. 27, 2002 (JP) ..... P2002-246231
Aug. 29, 2002 (JP) ..... P2002-251147
Oct. 22, 2002 (JP) ..... P2002-306594

(51) Int. Cl.
*B41J 2/395* (2006.01)

(52) U.S. Cl. ..... 347/112

(58) Field of Classification Search ..... 347/141–150, 347/199, 208; 246/139 C
See application file for complete search history.

(56) References Cited

U.S. PATENT DOCUMENTS 4,546,364 A * 10/1985 Todoh ..... 347/147
4,977,416 A * 12/1990 Bibl et al. ..... 347/147
6,518,990 B1 * 2/2003 Koga et al. ..... 347/141
6,618,065 B1 * 9/2003 Koga et al. ..... 347/141

FOREIGN PATENT DOCUMENTS

JP 58-101080 * 6/1983
JP 03-143644 * 6/1991
JP 03-150173 * 6/1991
JP 2002-113897 A 4/2002
JP 2002-172813 A 6/2002

* cited by examiner

*Primary Examiner*—Huan Tran
(74) *Attorney, Agent, or Firm*—Sughrue Mion, PLLC

(57) ABSTRACT

In a writing head for forming an electrostatic latent image on a cylindrical image carrier, a plurality of writing electrodes are arranged on a first face of a film substrate in a first direction parallel with an axial direction of the image carrier. The writing electrodes are adapted to be abutted against an outer periphery of the image carrier to provide electric charges thereto. A first wiring member are arranged on the first face of the film substrate to supply signals from a first electrode driver to a first electrode group in the writing electrodes. A second writing member are arranged on a second face of the film substrate to supply signals from a second electrode driver to the second electrode group in the writing electrodes.

16 Claims, 33 Drawing Sheets

ELECTROSTATIC LATENT IMAGE WRITING HEAD, METHOD OF MANUFACTURING THE SAME AND IMAGE FORMING APPARATUS INCORPORATING THE SAME

BACKGROUND OF THE INVENTION

The present invention relates to a writing head in which a plurality of writing electrodes are arranged on a flexible support substrate and are disposed in contact with or in close proximity to a latent image carrier to supply writing voltages to the latent image carrier to form an electrostatic latent image thereon. The invention also relates to an image forming apparatus incorporating such a writing head.

In conventional image forming apparatus such as electrostatic copiers and printers, in general, the surface of a photosensitive body is charged uniformly by a charging device and the photosensitive body surface is exposed to light of an exposing device such as laser light, light of an LED lamp, or the like to form an electrostatic latent image thereon. The electrostatic latent image is developed by a developing device to form a toner image on the photosensitive body surface. The toner image is transferred to a medium such as a sheet of paper by a transferring device, whereby an image is formed on the transferring member.

In such conventional, general image forming apparatus are large and complex in structure because the exposing device for writing an electrostatic latent image is a device for emitting laser light or LED lamp light or the like. In view of this, an image forming apparatus has been proposed in which an electrostatic latent image is written to the surface of an image carrier by using writing electrodes instead of laser light or LED lamp light.

FIG. 36 is a perspective view of part of an example of such a writing head. The writing head 3 is composed of a flexible support substrate 3*a,* a plurality of wiring portions 3*c* (only two of them are shown in FIG. 36) that are a plurality of strip conductors arrayed on the support substrate 3*a* in the primary scanning direction of a latent image carrier 2, and writing electrodes 3*b* as projections that project toward the latent image carrier 2 from one ends of the respective wiring portions 3*c*.

For example, the writing head 3 is formed by the following process. A conductor to be electrodes made of copper or the like is joined to an elastic and flexible insulative material to be a support substrate, and the conductor is coated with a photoresist. The photoresist is covered with a mask pattern corresponding to a wiring pattern and then exposure is performed. As a result, a writing head 3 is formed in which wiring portions 3*c* and writing electrodes 3*b* as rectangular parallelepiped or cubic projections that project from one ends of the respective wiring portions 3*c* are arranged on the support substrate 3*a*.

In a writing head disclosed in Japanese Patent Publication No. 2002-172813A, a plurality of writing electrodes 3*b* are arrayed on a flexible support substrate 3*a* in the primary scanning direction in the above-described manner. Two arrays of writing electrodes 3*b* are arranged in a secondary scanning direction. And drivers are disposed on both sides of the writing electrodes 3*b*.

In a latent image writing device disclosed in Japanese Patent Publication No. 2002-113897A, a plurality of writing electrodes are disposed in contact with or in close proximity to a latent image carrier in the above-described manner. A support substrate on which the writing electrodes are formed is pressed against the latent image carrier by a support member, a pressing member, and an urging member. This structure provides a large nip width with weak load.

It is also well-known that writing electrodes are arrayed in the axial direction of an image carrier. It is also well-known that a writing electrode formed on a flexed film-shaped substrate is brought into press contact with an image carrier with the aid of the elastic restoration force of the film-shaped substrate.

However, in the case where the writing electrodes are arrayed in the axial direction of the image carrier, current crosstalk may occur because of a small interval between the wiring portions of adjacent writing electrodes and it is difficult to increase the number of writing electrodes to enhance the resolution.

In the case where the two arrays of the writing electrodes are arranged in the secondary scanning direction, the crosstalk problem can be solved. However, it is difficult to assure high accuracy of positioning among the writing electrodes. Further, it is not suitable for downsizing because the writing electrodes occupy a large space, thereby increasing costs.

In the case where a writing electrode formed on a flexed film-shaped substrate, it is very difficult to stably bring the writing electrodes into contact with the image carrier because the elastic restoration force of the film-shaped substrate is unstable. Further, this method is not suitable for downsizing because the writing head occupies a large space.

In the above-described writing head that is composed of the flexible support substrate and the plural writing electrodes arrayed in the primary scanning direction, the rigidity is much lower in the portions between the electrodes or wiring patterns than in the electrodes or wiring patterns. Therefore, the writing head tends to wave or wrinkle in the primary scanning direction and hence it is difficult to stably bring the writing head into contact with the latent image carrier. As a result, an electrostatic latent image is not formed correctly on the latent image carrier, deteriorating the print quality.

In the writing head in which the two arrays of writing electrodes are arranged in the secondary scanning direction and the drivers are disposed on both sides of the support substrate, no wiring pattern exists in the region between the two arrays of writing electrodes and hence the rigidity is much lower there than in the other portions. Stress is concentrated in the low-rigidity portion and the writing head tends to be bent there: as in the above case, it is difficult to stably bring the two arrays of writing heads into contact with the latent image carrier. As a result, an electrostatic latent image is not formed correctly on the latent image carrier, deteriorating the print quality. If the writing head is bent, the distance between the two arrays of writing electrodes varied, resulting in a problem that disorder in the dot pitch of an electrostatic latent image causes horizontal streaks.

SUMMARY OF THE INVENTION

It is therefore an object of the invention to provide an electrostatic latent image writing head capable of obtaining a high resolution image, capable of solving the current crosstalk problem, and capable of stably bringing the writing electrodes into contact with an image carrier.

It is also an object of the invention to eliminate a local region having low stiffness between the writing electrodes or the wiring patterns, thereby preventing the waving or the wrinkle of the writing head and bringing the writing electrodes into contact with the image carrier stably.

It is also an object of the invention to provide a method of manufacturing such a writing head.

In order to achieve the above object, according to the invention, there is provided a writing head for forming an electrostatic latent image on a cylindrical image carrier, comprising:

a flexible film substrate;

a plurality of writing electrodes, arranged on a first face of the film substrate in a first direction parallel with an axial direction of the image carrier, the writing electrodes adapted to be abutted against an outer periphery of the image carrier to provide electric charges thereto;

a first wiring member, arranged on the first face of the film substrate to supply signals from a first electrode driver to a first electrode group in the writing electrodes; and a second writing member, arranged on a second face of the film substrate to supply signals from a second electrode driver to the second electrode group in the writing electrodes.

Preferably, the film substrate is formed with at least one through hole through which the second wiring member extends to the second electrode group. Alternatively, the second wiring member may extend to the second electrode group via a side edge of the film substrate.

The first face and the second face of the film substrate may be defined by a single outer face of a folded film member.

The writing electrodes may be arranged so as to form a plurality of arrays which are arranged in a second direction perpendicular to the first direction.

Here, it is preferable that the writing electrodes are arranged such that writing electrodes in adjacent arrays forms a zigzag arrangement with regard to the first direction. Alternatively, the writing electrodes may be arrayed with regard to both of the first direction and the second direction.

Preferably, the film substrate comprises a first layer forming the first face and a second layer forming the second face. The wiring head further comprises a third wiring member, arranged between the first layer and the second layer to supply signals from a third electrode driver to a third electrode group in the writing electrode.

Preferably, the film substrate is integrally formed with a reinforcement member which provides a reinforcement for the film substrate in a second direction perpendicular to the first direction.

Here, it is preferable that the reinforcement member extends in the first direction so as to support at least a region where the writing electrodes are arranged.

In a case where the writing electrodes are arranged so as to form a plurality of arrays which are arranged in the second direction, it is preferable that the reinforcement member extends in the second direction so as to support at least a region where the arrays of the writing electrodes are arranged.

Alternatively, the reinforcement member extends so as to avoid a portion where each of the writing electrodes is disposed.

According to the invention, a writing head for forming an electrostatic latent image on a cylindrical image carrier, comprising:

a flexible film substrate;

a plurality of writing electrodes, arranged on a first face of the film substrate in a first direction parallel with an axial direction of the image carrier, the writing electrodes adapted to be abutted against an outer periphery of the image carrier to provide electric charges thereto;

a wiring member, arranged on the first face of the film substrate to supply signals from an electrode driver to the writing electrodes; and a reinforcement member, integrally formed with the film substrate to provide a reinforcement for the film substrate in a second direction perpendicular to the first direction.

Preferably, the reinforcement member extends in the first direction so as to support at least a region where the writing electrodes are arranged.

In a case where the writing electrodes are arranged so as to form a plurality of arrays which are arranged in the second direction, it is preferable that the reinforcement member extends in the second direction so as to support at least a region where the arrays of the writing electrodes are arranged.

Alternatively, the reinforcement member may extend so as to avoid a portion where each of the writing electrodes is disposed.

Preferably, the reinforcement member is formed on a second face of the film substrate.

According to the invention, there is also provided an image forming apparatus for forming a visible image from the electrostatic latent image formed by any one of the above wiring heads.

According to the invention, there is also provided a method of manufacturing a writing head for forming an electrostatic latent image on an image carrier, comprising steps of:

providing a flexible film member;

forming a plurality of writing electrodes on a first face of the film member;

forming a first wiring member on the first face of the film member so as to be connected to a first electrode group in the writing electrodes;

forming a second wiring member on the first face of the film member so as to be connected to a second electrode group in the writing electrodes;

defining a folding line on the film member so as to avoid the writing electrodes; and folding the film member at the folding line to form a film substrate, such that the first wiring member and the second wiring member are arranged on opposite faces of the film substrate.

Preferably, an adhesive agent is applied on at least a part of a second face of the film member which is to be an inner face at the step of folding the film member.

DETAILED DESCRIPTION OF THE INVENTION

Embodiments of the present invention will be hereinafter described with reference to the accompanying drawings.

Figure 1A:
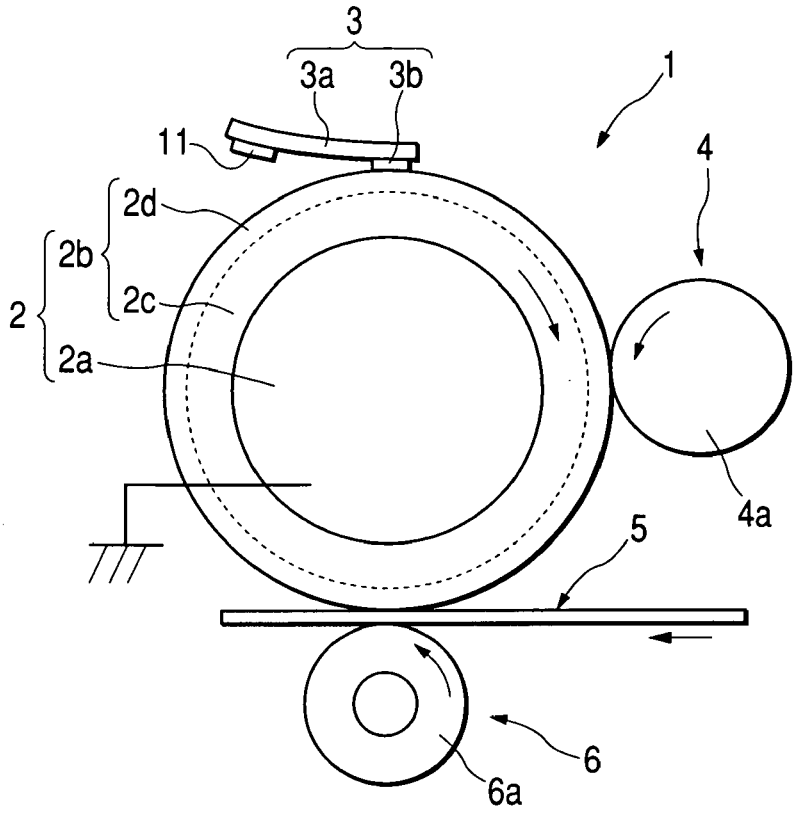
FIG. 1A is a schematic diagram showing a first example of an image forming apparatus according to the present invention.

As shown in FIG. 1A, an image forming apparatus 1 according to the invention is at least provided with the following components. An image carrier 2 has a base member 2*a* that is made of a conductive material such as aluminum and is grounded and an insulative charge-bearing layer 2*b* that is provided outside the base member 2*a* and on which an electrostatic latent image is to be formed. A writing head 3 comprises: a film-shaped substrate 3*a* that is provided as an FPC (flexible printed circuit) and is made of highly insulative, relatively soft, elastic, and flexible material such as PET (polyethylene terephthalate); and writing electrodes 3*b* that are supported by the film-shaped substrate 3*a* to write an electrostatic latent image on the charge-bearing layer 2*b* of the image carrier 2 in a state that they are brought into weak contact with the charge-bearing layer 2*b* by weak elastic restoration force that is produced by the flexed film-shaped substrate 3*a*. A developing device 4 has a developing roller 4*a* serving as a developer carrier. A transferring device 6 has a transferring roller 6*a* serving as a transferring member.

Figure 1B:
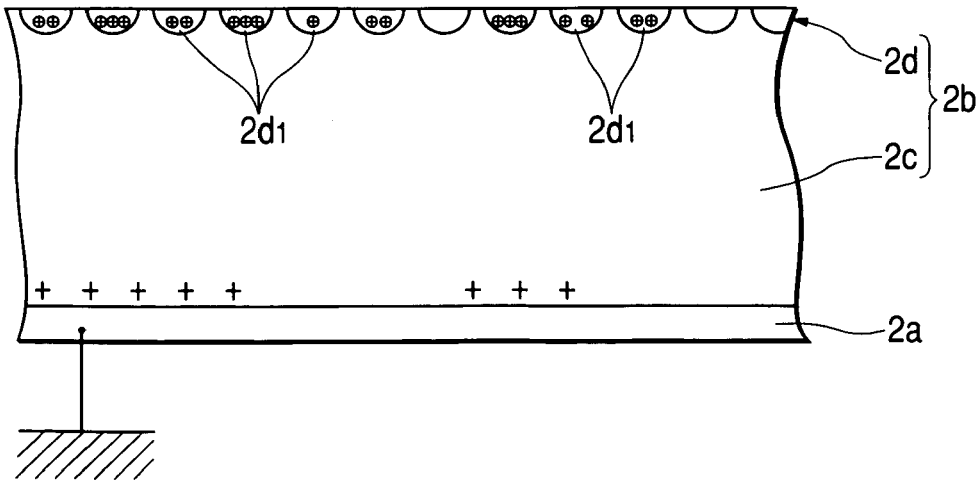
FIG. 1B is an enlarged schematic diagram showing a surface portion of an image carrier of the above image forming apparatus.

The charge-bearing layer 2*b* is composed of a dielectric layer (insulating layer) 2*c* and an independent electrode portion 2*d* that is an image writing portion provided in the surface layer of the dielectric layer 2*c*. As shown in FIG. 1B, the independent electrode portion 2*d* is formed by a large number of independent floating electrodes (hereinafter also referred to simply as "independent electrodes") $2d_1$ arranged in the surface layer of the dielectric layer 2*c*. The independent electrodes $2d_1$ have an island structure in which they are electrically independent of each other and are exposed in the surface of the dielectric layer 2*c*. Although FIG. 1A is drawn in such a manner that the independent electrodes 2*d* are divided from the dielectric layer 2*c*, this is merely for convenience of description. As clearly shown in FIG. 1B, the independent electrodes 2*d* are not clearly divided from the dielectric layer 2*c*: the independent electrode portion 2*d* is a portion where a large number of electrodes $2d_1$ exist in the surface layer of the dielectric layer 2*c*.

An image is written to the independent electrode portion 2*d* in such a manner that plus voltages, for example, that are supplied via IC drivers 11 are applied from writing electrodes 3*b* to the independent electrode portion 2*d* as a writing voltage $V_1$ and image writing portions of the independent electrode portion 2*d* are charged positively.

Examples of the material of the dielectric layer 2*c* are a polyester resin, a polycarbonate resin, an acrylic resin, a polystyrene resin, polyallylate, polysulfone, poly(phenylene oxide), a vinyl chloride resin, a polyurethane resin, an epoxy resin, a silicone resin, an alkyd resin, a phenol resin, a polyamide resin, and a vinyl chloride-vinyl acetate copolymer resin and polymer alloys of two or more of them.

In the independent electrode portion 2*d*, a large number of independent electrodes $2d_1$ are formed by applying a liquid in which one of the above resins and a large number of conductive fine particles are dispersed in a solvent (diluted mixing dispersion) with adjustment of the mixing ratio (i.e., densities) to the surface of the dielectric layer 2*c* by a common, proper method such as spraying or dipping. The resulting independent electrodes $2d_1$ are exposed in the surface. Alternatively, a large number of independent electrodes $2d_1$ may be exposed by polishing. This provides advantages that increased surface smoothness decreases the contact resistance with the writing electrodes 3*b* and the abrasion of the writing head 3 and the charge-bearing layer 2*b*. Examples of the material of the conductive fine particles are:

i) Metal fine particles of Cu, Al, Ni, Ag, C, Mo, etc.

ii) Fine particles produced by making zinc oxide (ZnO), tin oxide, antimony oxide, titanium oxide, or the like conductive (by doping with antimony, indium, or the like).

iii) Conductive fine particles as polymer complexes produced by doping polyacetylene, polythiophine, polypyrrole, or the like with iodine.

In the above-configured image forming apparatus 1, after the charge-bearing layer 2*b* of the image carrier 2 is rendered in a uniformly charged state, writing voltages are supplied to writing electrodes 3*b* via the IC drivers 11 for the writing electrodes 3*b* and an electrostatic latent image is written to the image carrier 2 in a uniformly charged state mainly through charge transfer (e.g., charge injection) between the image carrier 2 and the writing electrodes 3*b* of the writing head 3 that are in surface contact with each other. The electrostatic latent image on the image carrier 2 is then written to the charge-bearing layer 2*b* of the image carrier 2. The electrostatic latent image on the charge-bearing layer 2*b* of the image carrier 2 is developed with a developer that is transported by the developing roller 4*a* of the developing device 4. A resulting developer image is transferred to a medium 5 such as a sheet of paper by the transferring roller 6*a* to which a transfer voltage is applied.

Figure 2A:
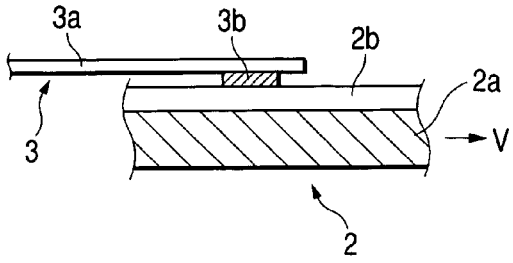
FIGS. 2A–2F are views for explaining the writing principle of an electrostatic latent image.

As shown in FIG. 2A, the image carrier 2 is composed of the base member 2*a* that is made of a conductive material such as aluminum and is grounded and the insulative charge-bearing layer 2*b* that is provided outside the base member 2*a*. As described above, the writing electrodes 3*b* of the writing device 3 that are supported by the film-shaped substrate 3*a* such as an FPC are brought into contact with the charge-bearing layer 2*b* by a predetermined, weak pressing force. The image carrier 2 is rotated at a predetermined speed V. To stabilize the contact between the writing electrodes 3*b* and the image carrier 2 and to stabilize the charge injection or discharge, it is preferable that the weak pressing force be 10 N or less for a width 300 mm, that is, the linear pressure be 0.03 N/mm or less. From the viewpoint of abrasion, it is desirable that the linear pressure be made as low as possible while the contact is kept stable.

A predetermined high voltage $V_0$ or a predetermined low voltage $V_1$ is selectively (with switching) applied to a writing electrode 3*b* via the film-shaped substrate 3*a*. As described above, the charge has the polarities (plus and minus). The term "high voltage" means a voltage having a large absolute value and the term "low voltage" means a voltage having a smaller absolute value than the high voltage (but the same polarity) or 0 V. In this specification, all low voltages are assumed to be the ground voltage. Therefore, in the following description, the high voltage $V_0$ and the low voltage $V_1$ will be referred to as "predetermined voltage $V_1$" and "ground voltage $V_1$," respectively. It goes without saying that the ground voltage $V_1$ is 0 V.

Figure 2B:
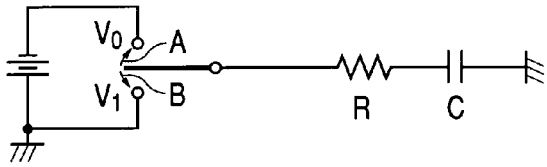

That is, an electrical equivalent circuit shown in FIG. 2B is formed at the contact portion (i.e., nip portion) between a writing electrode 3*b* and the image carrier 2. In FIG. 2B, character R represents the resistance of the writing electrode 3*b* and C represents the capacitance of the image carrier 2. The resistance R of the writing electrode 3*b* is selectively connected (with switching) to the A-side predetermined (minus) voltage $V_0$ or the B-side ground voltage $V_1$.

Figure 2C:
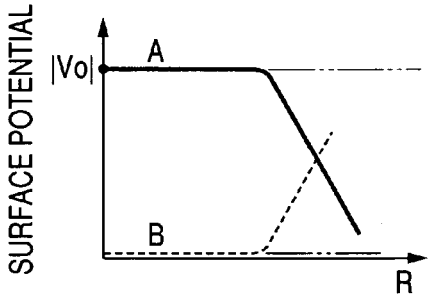

In the equivalent circuit, as indicated by a solid line in FIG. 2C, when the writing electrode 3*b* is connected to the A-side and the predetermined minus voltage $V_0$ is applied to the writing electrode 3*b*, the resistance R of the writing electrode 3*b* and the surface potential of the image carrier 2 have a relationship that the surface potential of the image carrier 2 is constant, that is, equal to the predetermined voltage $V_0$, in a range in which the resistance R is small and the absolute value of the surface potential of the image carrier 2 decreases as the resistance R increases in a range in which the resistance R is larger than a predetermined value.

On the other hand, as indicated by a dashed line in FIG. 2C, when the writing electrode 3*b* is connected to the B-side and hence is grounded, the resistance R of the writing electrode 3*b* and the surface potential of the image carrier 2 have a relationship that the surface potential of the image carrier 2 is constant, that is, approximately equal to the ground voltage $V_1$, in a range in which the resistance R is small and the absolute value of the surface potential of the image carrier 2 increases with the resistance R in a range in which the resistance R is larger than a predetermined value.

Figure 3A:
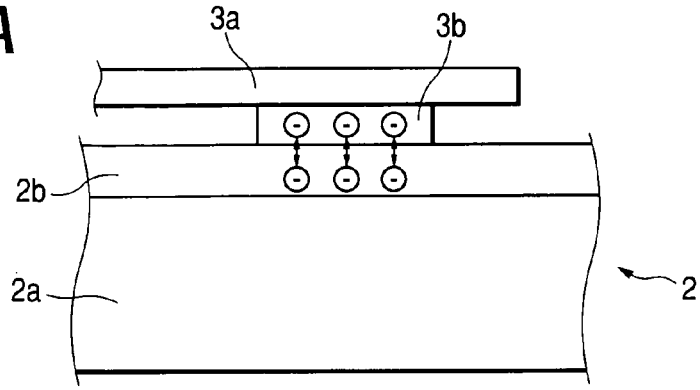
FIGS. 3A–3C are views for explaining the charging or discharging principle of the image carrier.
Figure 3B:
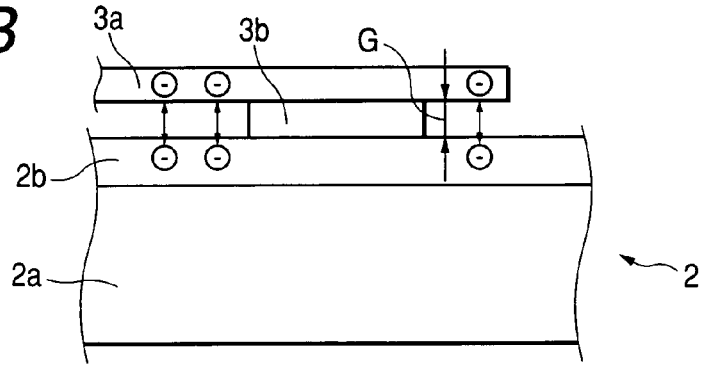

In the range in which the resistance R of the writing electrode 3*b* is small and the surface potential of the image carrier 2 is constant and equal to the predetermined voltage $V_0$ or the ground voltage $V_1$, as shown in FIG. 3A minus charge is directly injected from the low-voltage side to the high-voltage side between the writing electrode 3*b* that is in contact with the image carrier 2 and the charge-bearing layer 2*b* of the image carrier 2. That is, the image carrier 2 is charged or discharged by the charge injection. In the range in which the resistance R of the writing electrode 3*b* is large and the surface potential of the image carrier 2 starts to vary, the degree of charging or discharging of the image carrier 2 by the charge injection decreases as the resistance R increases. As the resistance R increases, as indicated by arrows in FIG. 3B discharge comes to occur between a conductive pattern (described later) of the film-shaped substrate 3*a* and the image carrier 2.

Figure 3C:
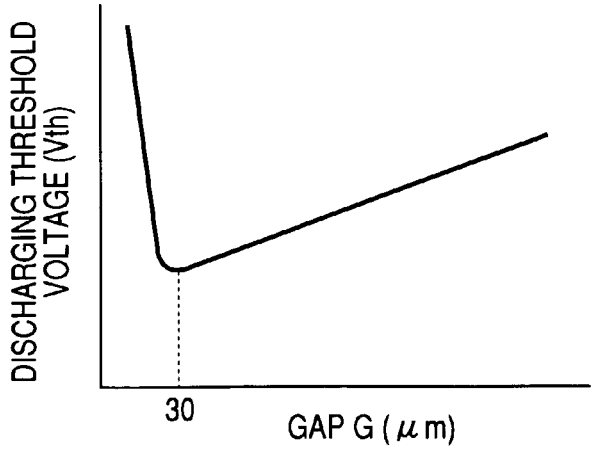

Charge release occurs between the conductive pattern of the film-shaped substrate 3*a* and the base member 2*a* of the image carrier 2 when the absolute value of the voltage between the film-shaped substrate 3*a* and the image carrier 2 (i.e., the predetermined voltage $V_0$) is higher than a threshold voltage $V_{th}$ for the charge release. FIG. 3C shows a relationship between the threshold voltage $V_{th}$ and the gap G between the film-shaped substrate 3*a* and the image carrier 2 (Paschen's law). That is, the threshold voltage $V_{th}$ is minimum when the gap G is equal to about 30 $\mu$m and the threshold voltage $V_{th}$ increases, that is, the charge release becomes less apt to occur, as the gap G decreases or increases from about 30 $\mu$m. The surface of the image carrier 2 is charged or discharged also by such charge release. However, when the resistance R of the writing electrode 3 is in this range, the degree of charging or discharging by the charge injection becomes high and that by the charge release becomes low; that is, the charging or discharging of the image carrier 2 is dominated by the charge injection.

In the case of the charging or discharging by the charge injection, the surface potential of the image carrier 2 is equal to the predetermined voltage $V_0$ or the ground voltage $V_1$ that is applied to the writing electrode 3*b*. In the case of the charging or discharging by the charge injection, it is desirable that the predetermined voltage $V_0$ applied to the writing electrode 3*b* be set lower than the threshold voltage $V_{th}$ above which the charge release occurs between the writing electrode 3*b* and the base member 2*a* of the image carrier 2.

In the range in which the resistance R of the writing electrode 3*b* is even larger, the degree of charging or discharging by the charge injection becomes low and that by the charge release becomes high; that is, the charging or discharging of the image carrier 2 is dominated by the charge release. That is, as the resistance R of the writing electrode 3*b* increases, the surface of the image carrier 2 comes to be mainly charged or discharged by the charge release and the contribution of the charge injection becomes negligible. In the case of the charging or discharging by the charge release, the surface potential of the image carrier 2 is equal to the predetermined voltage $V_0$ or the ground potential $V_1$ that is applied to the writing electrode 3*b* minus the threshold voltage $V_{th}$. The same is true of the case that the predetermined voltage $V_0$ is positive.

Therefore, the charging or discharging of the image carrier 2 can be performed by the charge injection by setting the resistance R of the writing electrode 3*b* small in a range in which the surface potential of the image carrier 2 is constant and equal to the predetermined voltage $|V_0|$ (an absolute value is employed because $V_0$ may be a plus or minus voltage) or the ground voltage $V_1$ and switching-controlling the voltage applied to the writing electrode 3*b* between the predetermined voltage $V_0$ and the ground voltage $V_1$.

Figure 2D:
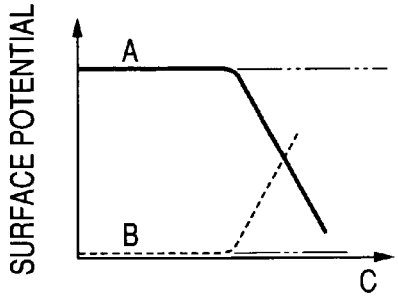

As indicated by a solid line in FIG. 2D, when the writing electrode 3*b* is connected to the A-side and the predetermined minus voltage $V_0$ is applied to the writing electrode 3*b*, the capacitance C of the image carrier 2 and the surface potential of the image carrier 2 have a relationship that the surface potential of the image carrier 2 is constant, that is, equal to the predetermined voltage $V_0$, in a range in which the capacitance C is small and the absolute value of the surface potential of the image carrier 2 decreases as the capacitance C increases in a range in which the capacitance C is larger than a predetermined value. On the other hand, as indicated by a dashed line in FIG. 2D, when the writing electrode 3*b* is connected to the B-side and hence is grounded, the capacitance C of the image carrier 2 and the surface potential of the image carrier 2 have a relationship that the surface potential of the image carrier 2 is constant, that is, approximately equal to the ground voltage $V_1$, in a range in which the capacitance C is small and the absolute value of the surface potential of the image carrier 2 increases with the capacitance C in a range in which the capacitance C is larger than a predetermined value.

In the range in which the capacitance C of the image carrier 2 is small and the surface potential of the image carrier 2 is constant and equal to the predetermined voltage $V_0$ or the ground voltage $V_1$, as shown in FIG. 3A minus charge is directly injected between the writing electrode 3*b* that is in contact with the image carrier 2 and the charge-bearing layer 2*b* of the image carrier 2. That is, the image carrier 2 is charged or discharged by the charge injection.

In the range in which the capacitance C of the image carrier 2 is large and the surface potential of the image carrier 2 starts to vary, the degree of charging or discharging of the image carrier 2 by the charge injection decreases as the capacitance D increases. As the capacitance C increases, as indicated by arrows in FIG. 3B, the charge release comes to occur between the film-shaped substrate 3*a* and the image carrier 2. The surface of the image carrier 2 is charged or discharged also by such charge release. However, when the capacitance C of the writing electrode 3 is in this range, the degree of charging or discharging by the charge injection is high and that by the charge release is low; that is, the charging or discharging of the image carrier 2 is dominated by the charge injection. In the case of the charging or discharging by the charge injection, the surface potential of the image carrier 2 is equal to the predetermined voltage $V_0$ or the ground voltage $V_1$ that is applied to the writing electrode 3*b*.

In the range in which the capacitance C of the image carrier 2 is even larger, almost no charge injection is performed between the writing electrode 3*b* and the image carrier 2, that is, the image carrier 2 is not discharged or discharged by the charge injection. The same is true of the case that the predetermined voltage $V_0$ is positive.

Therefore, the charging or discharging of the image carrier 2 can be performed by the charge injection by setting the capacitance C of the image carrier 2 small in a range in which the surface potential of the image carrier 2 is constant and equal to the predetermined voltage $|V_0|$ (an absolute value is employed because $V_0$ may be a plus or minus voltage) or the ground voltage $V_1$ and switching-controlling the voltage applied to the writing electrode 3*b* between the predetermined voltage $V_0$ and the ground voltage $V_1$.

Figure 2E:
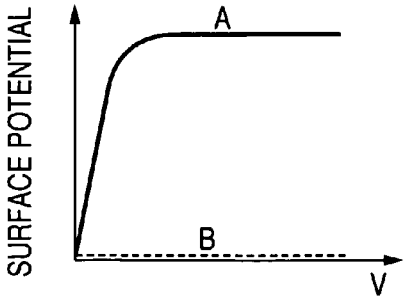

Further, as indicated by a solid line in FIG. 2E, when the writing electrode 3*b* is connected to the A-side and the predetermined minus voltage $V_0$ is applied to the writing electrode 3*b*, the speed (circumferential speed) v of the image carrier 2 and its surface potential have a relationship that the surface potential of the image carrier 2 increases with the speed v and the absolute value of surface potential of the image carrier 2 becomes constant after the speed v of the image carrier 2 exceeds a predetermined value. The phenomenon that the surface potential of the image carrier 2 increases with the speed v is considered due to facilitation of the charge injection into the image carrier 2 by the friction between the writing electrode 3*b* and the image carrier 2. The degree of facilitation of the charge injection into the image carrier 2 becomes almost constant after the speed v of the image carrier 2 exceeds a certain value.

On the other hand, as indicated by a dashed line in FIG. 2E, when the writing electrode 3*b* is connected to the B-side and is hence grounded, the speed v of the image carrier 2 and its surface potential have a relationship that the surface potential of the image carrier 2 is constant and equal to the ground voltage $V_1$, that is, it is independent of the speed v of the image carrier 2. The same is true of the case that the predetermined voltage $V_0$ is positive.

Still further, as indicated by a solid line in FIG. 2F, when the writing electrode 3*b* is connected to the A-side and the predetermined minus voltage $V_0$ is applied to the writing electrode 3*b*, the pressing force of the writing electrode 3*b* acting on the image carrier 2 (hereinafter referred to simply as "pressure of the writing electrode 3*b*") and the surface potential of the image carrier 2 have a relationship that the surface potential of the image carrier 2 increases relatively steeply with the pressure of the writing electrode 3*b* and the absolute value of surface potential of the image carrier 2 becomes constant after the pressure of the writing electrode 3*b* exceeds a predetermined value. The phenomenon that the surface potential of the image carrier 2 increases steeply with the pressure of the writing electrode 3*b* is considered due to the fact that the contact between the writing electrode 3*b* and the image carrier 2 becomes securer as the pressure of the writing electrode 3*b* increases. The degree of secureness of the contact between the writing electrode 3*b* and the image carrier 2 becomes almost constant after the pressure of the writing electrode 3*b* exceeds a certain value.

Figure 2F:
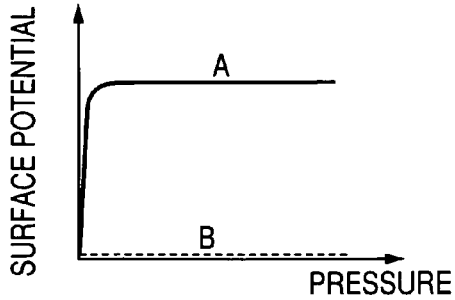

On the other hand, as indicated by a dashed line in FIG. 2F, when the writing electrode 3*b* is connected to the B-side and is hence grounded, the pressure of the writing electrode 3*b* and the surface potential of the image carrier 2 have a relationship that the surface potential of the image carrier 2 is constant and equal to the ground voltage $V_1$, that is, it is independent of the pressure of the writing electrode 3*b*. The same is true of the case that the predetermined voltage $V_0$ is positive.

As described above, the charging or discharging of the image carrier 2 by the charge injection can be performed reliably and easily by setting the resistance R of the writing electrode 3*b* and the capacitance C of the image carrier 2 so that the surface potential of the image carrier 2 is kept at a constant, predetermined voltage, controlling the speed v of the image carrier 2 and the pressure of the writing electrode 3*b* so that the surface potential of the image carrier 2 is kept at the constant, predetermined voltage, and switching-controlling the voltage applied to the writing electrode 3*b* between the predetermined voltage $V_0$ and the ground voltage $V_1$.

Although in the above example the predetermined voltage $V_0$ that is a DC voltage is applied to the writing electrode 3*b*, the voltage applied to the writing electrode 3*b* may be such that an AC voltage is superimposed on a DC voltage. In the latter case, it is preferable that the DC component be set to a voltage to be applied to the image carrier 2, the amplitude of the AC voltage be set to two or more times the threshold voltage $V_{th}$, and the frequency of the AC component be set to about 500 to 1,000 times the rotation frequency of the image carrier 2 (e.g., of the diameter of the image carrier 2 is 30 mm and its circumferential speed is 180 mm/s, the rotation frequency of the image carrier 2 is equal to about 2 Hz and hence the frequency of the AC component should be set to 1,000 to 2,000 Hz).

Superimposing an AC voltage on a DC voltage as described above makes the charging or discharging of the writing electrode 3*b* due to the charge release more stable. Further, since the writing electrode 3*b* is vibrated by the AC voltage, foreign matter that is attached to the writing electrode 3*b* can be removed and hence the writing electrode 3*b* is prevented from being stained.

Figure 4:
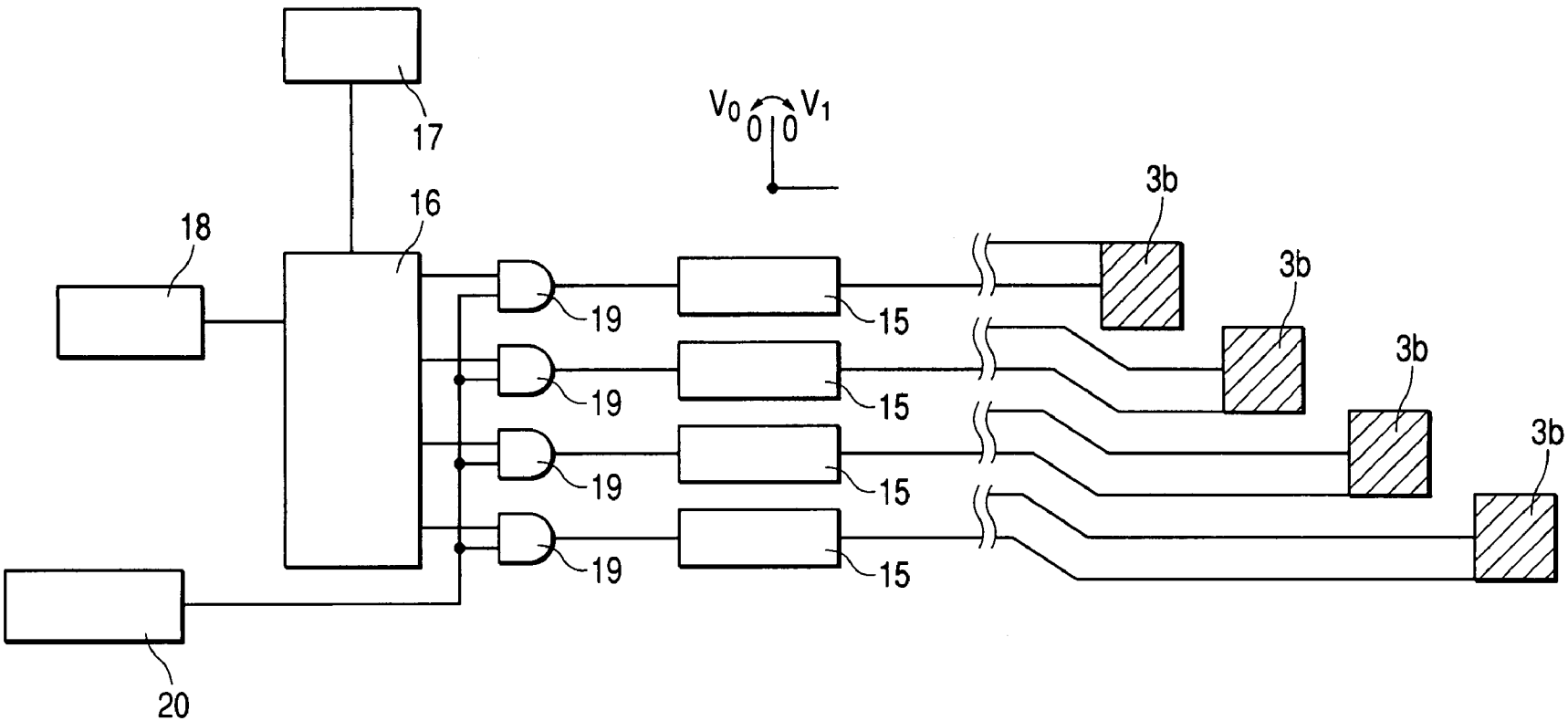
FIG. 4 is a schematic diagram of a switching circuit for writing electrodes in the above image forming apparatus.

FIG. 4 shows a switching circuit for selectively supplying (with switching) the predetermined voltage $V_0$ or the ground voltage $V_1$ to the writing electrodes 3*b*. The writing electrodes 3*b* that are arranged in four arrays, for example, are connected to respective high-voltage switches 15 which supply (with switching) the predetermined voltage $V_0$ or the ground voltage $V_1$ to the respective writing electrodes 3*b*. An image writing control signal is supplied from a shift register 16 to each high-voltage switch 15. An image signal stored in a buffer 17 and a clock signal supplied from a clock generator 18 are input to the shift register 16. Each image writing control signal that is output from the shift register 16 is input, by an associated AND gate 19, to the associated high-voltage switch 15 on the basis of a write timing signal that is supplied from an encoder 20. The high-voltage switches 15 and the AND gates 19 constitute the above-mentioned driver 11 for switching-controlling the voltages to be supplied to the respective writing electrodes 3*b*.

Figure 5A:
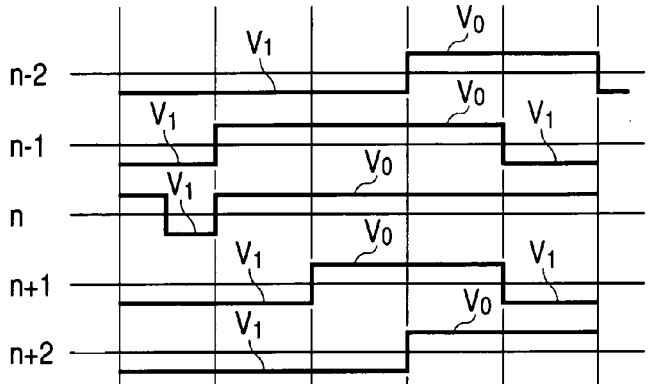
FIGS. 5A–5C are views for explaining a developer image that is formed by switching-controlling the writing electrodes by using the above switching circuit.
Figure 5B:
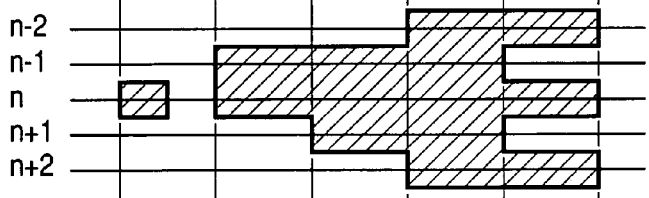
Figure 5C:
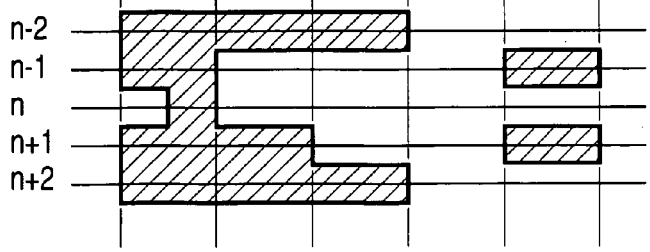

Referring to FIG. 5A, assume that the predetermined voltage $V_0$ or the ground voltage $V_1$ is applied to (n−2)th, (n−1)th, nth, (n+1)th, and (n+2)th electrodes 3*b* by switching control of the high-voltage switches 15. If an electrostatic latent image is written to the image carrier 2 by the electrodes 3*b* being in such voltage states and subjected to normal development, a developer is stuck to portions of the image carrier 2 to which the predetermined voltage $V_0$ is applied, whereby a developer image as hatched in FIG. 5B is obtained. If an electrostatic latent image is written in the same manner and subjected to inverted development, a developer is stuck to portions of the image carrier 2 to which the ground voltage $V_1$ is applied, whereby a developer image as hatched in FIG. 5C is obtained.

In the image forming apparatus 1 using the above-configured writing head 3, the writing electrodes 3*b* can be kept in contact with the image carrier 2 in a stable manner because the writing electrodes 3*b* are brought in contact with the image carrier 2 by weak pressing force that is weak restoration force of the film-shaped substrate 3*a*. Therefore, the charging of the image carrier 2 by the writing electrodes 3*b* can be performed with high accuracy in a more stable manner. Since an electrostatic latent image can be written more stably, a good image can be obtained reliably with high accuracy.

Since the writing electrodes 3*b* are brought in contact with the image carrier 2 merely by weak pressing force, the image carrier 2 is prevented from being damaged by the writing electrodes 3*b* and hence the durability of the image carrier 2 can be increased. Further, since the writing device 3 uses the writing electrodes 3*b* and a large-size laser light generation device, LED lamp light generation device, or the like as used conventionally is not employed, the apparatus can further be miniaturized and the number of parts can further be reduced, which makes it possible to provide an image forming apparatus that is simpler and less expensive. Further, the use of the writing electrodes 3*b* is effective in suppressing ozone generation.

Figure 6:
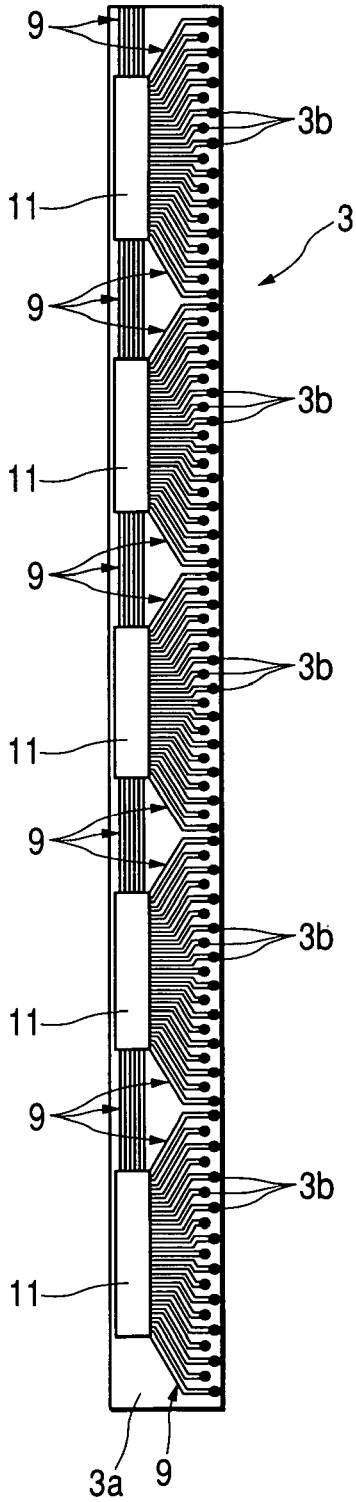
FIG. 6 is a plan view of a specific example of a writing head in the above image forming apparatus.

As shown in FIG. 6, the drivers 11 are formed on the film-shaped substrate 3*a* and electrically connected to each other by thin, flat-plate-shaped wiring portions 9 having a rectangular cross-section and made of copper foil, for example. Likewise, each driver 11 and a plurality of writing electrodes 3*b* are electrically connected to each other by wiring portions 9 that are formed on the film-shaped substrate 3*a*. The above wiring portions 9 can be formed by a conventional thin-film pattern forming method such as etching. Line data, a write timing signal, and a high voltage are supplied to the drivers 11 from the wiring portions 9 disposed at the upper side of the drawing.

Figure 7A:
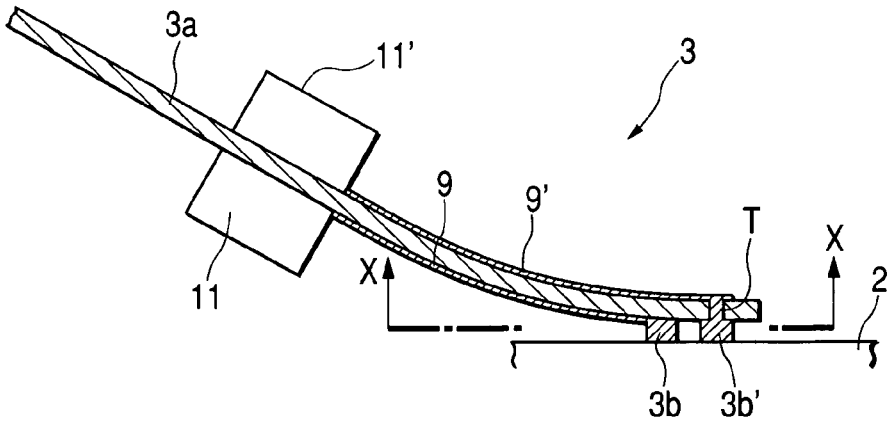
FIG. 7A is a side sectional view of a writing head according to a first embodiment of the invention.

FIG. 7A shows a writing head 3 according to a first embodiment of the invention in which two arrays of writing electrodes 3*b* and 3*b*′ are formed on a tip end portion of a first face of a film-shaped substrate 3*a* so as to be separated from each other in the secondary scanning direction (i.e., the moving direction of the image carrier 2). The writing electrodes 3*b* or 3*b*′ of each array are arranged in the primary scanning direction (i.e., parallel with the axial direction of the image carrier 2).

Drivers 11 and 11' are fixed to the two respective faces of the film-shaped substrate 3*a* at positions distant from the image carrier 2. The writing electrodes 3*b* that are more distant from the tip end of the film-shaped substrate 3*a* than the writing electrodes 3*b*′ and are connected to the first driver 11 via wiring portions 9 that are formed on the first face of the film-shaped substrate 3*a*. The tip-side writing electrodes 3*b*′ are electrically connected to the second driver 11' via conductive members in through holes T of the film-shaped substrate 3*a* and wiring portions 9' that are formed on the second face of the film-shaped substrate 3*a*.

Figure 7B:
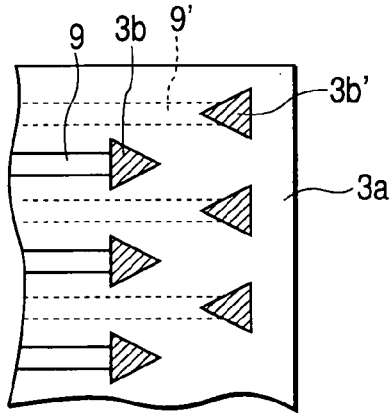
FIGS. 7B and 7C are plan views showing modified examples of the writing electrodes.
Figure 7C:
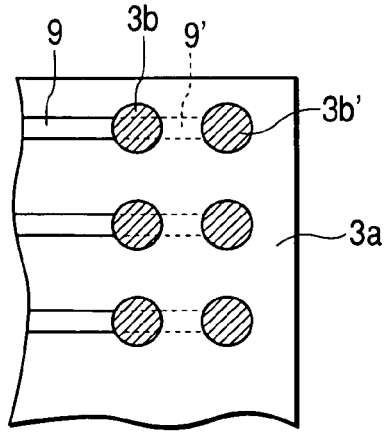

As for the arrangement pattern of the writing electrodes 3*b* and 3*b*′, in an example of FIG. 7B, the writing electrodes 3*b* of a first array and the writing electrodes 3*b*′ of a second array form a zigzag arrangement with regard to the axial direction of the image carrier 2 (that is, the first array of the writing electrodes 3*b* and the second array of the writing electrodes 3*b*′ are separated from each other in the secondary scanning direction and any one of the writing electrodes 3*b* and 3*b*′ are not aligned in the secondary scanning direction). In an example of FIG. 7C, the writing electrode 3*b* and the writing electrode 3*b*′ of each pair are aligned in the moving direction of the image carrier 2 and gradation control is enabled by turning on one or both of writing voltages for those writing electrodes 3*b* and 3*b*′. The shape of writing electrodes 3*b* and 3*b*′ is not limited to a triangle or a circle and they may assume arbitrary shapes such as a rectangle, a trapezoid, and a trapezium.

In this embodiment, the writing electrodes 3*b* and 3*b*′ are formed on the first face of the film-shaped substrate 3*a* and the wiring portions 9 and 9' corresponding to the writing electrodes 3*b* and 3*b*′ are formed on both faces of the film-shaped substrate 3*a*. Therefore, current crosstalk can be prevented and the wiring portions 9 and 9' can be arranged densely on both faces of the film-shaped substrate 3*a*, thereby stabilizing the elastic force of the film-shaped substrate 3*a*.

Figure 8A:
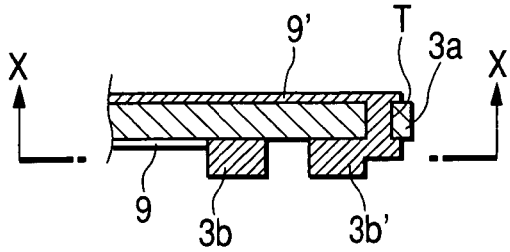
FIG. 8A is a side sectional view of a writing head according to a second embodiment of the invention.
Figure 8B:
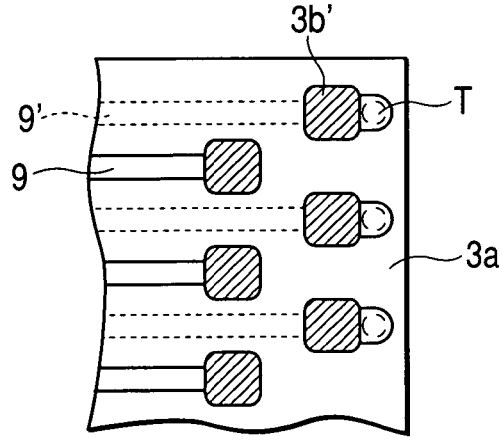
FIG. 8B is a plan view of the writing head of FIG. 8A as viewed from direction X shown in FIG. 8A.

FIGS. 8A and 8B show a writing head 3 according to a second embodiment of the invention. Whereas in the first embodiment the writing electrodes 3*b*′ of the second array are formed at the positions of the through holes T, in this embodiment the writing electrodes 3*b*′ of the second array are formed at positions distant from the through holes T.

Figure 9A:
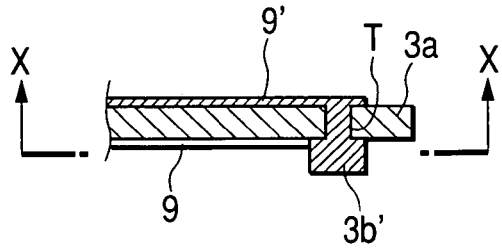
FIG. 9A is a side sectional view of a writing head according to a third embodiment of the invention.
Figure 9B:
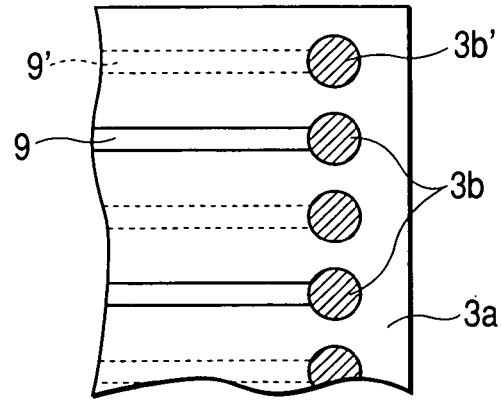
FIG. 9B is a plan view of the writing head of FIG. 9A as viewed from direction X shown in FIG. 9A.

FIGS. 9A and 9B show a writing head 3 according to a third embodiment of the invention. In this embodiment, writing heads 3*b* and 3*b*′ are alternately arrayed parallel with the axial direction of the image carrier 2. The writing electrodes 3*b*′ are electrically connected to the second driver 11' via conductive members in through holes T and wiring portions 9' that are formed on the second face of a film-shaped substrate 3*a*. In this embodiment, as in the case of the above embodiments, the writing electrodes 3*b* and 3*b*′ are formed on the first face of the film-shaped substrate 3*a* and the wiring portions 9 and 9' corresponding to the writing electrodes 3*b* and 3*b*′ are formed on both faces of the film-shaped substrate 3*a*. Therefore, current crosstalk can be prevented and the wiring portions 9 and 9' can be arranged densely on both faces of the film-shaped substrate 3*a*, thereby stabilizing the elastic force of the film-shaped substrate 3*a*.

Figure 10:
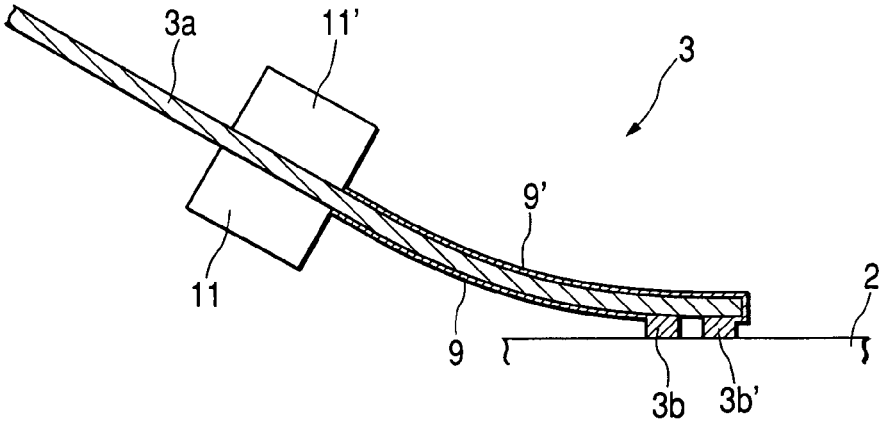
FIG. 10 is a side sectional view of a writing head according to a fourth embodiment of the invention.

FIG. 10 shows a writing head 3 according to a fourth embodiment of the invention. In this embodiment, two arrays of writing electrodes 3*b* and 3*b*′ are formed on a tip end portion of the first face of a film-shaped substrate 3*a* so as to be separated from each other in the secondary scanning direction (i.e., the moving direction of the image carrier 2). The writing electrodes 3*b* or 3*b*′ of each array are arranged in the primary scanning direction (i.e., parallel with the axial direction of the image carrier 2). Drivers 11 and 11' are fixed to the two respective faces of the film-shaped substrate 3*a* at positions distant from the image carrier 2. The writing electrodes 3*b* that are more distant from the tip end of the film-shaped substrate 3*a* than the writing electrodes 3*b*′ and are connected to the first driver 11 via wiring portions 9 that are formed on the first face of the film-shaped substrate 3*a*. The tip-side writing electrodes 3*b*′ are connected to the second driver 11' via wiring portions 9' that are formed on the tip end face and the second face of the film-shaped substrate 3*a*. This embodiment is effective in cost reduction because no through holes are formed.

Figure 11:
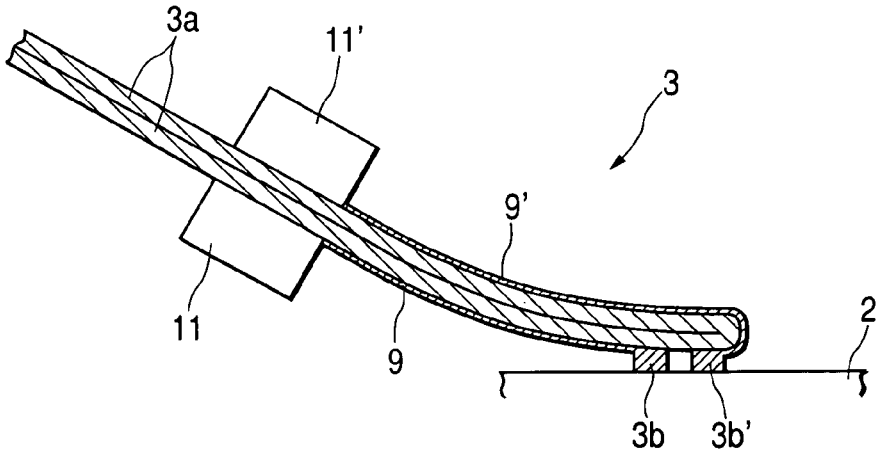
FIG. 11 is a side sectional view of a writing head according to a fifth embodiment of the invention.

FIG. 11 shows a writing head 3 according to a fifth embodiment of the invention. In this embodiment, an original film-shaped substrate 3*a* is folded and the resulting inside surfaces are bonded to each other. Two arrays of writing electrodes 3*b* and 3*b*′ are formed on a tip end portion of the first face of the resulting film-shaped substrate 3*a* so as to be separated from each other in the secondary scanning direction (i.e., the moving direction of the image carrier 2). The writing electrodes 3*b* or 3*b*′ of each array are arranged in the primary scanning direction (i.e., parallel with the axial direction of the image carrier 2). Drivers 11 and 11' are fixed to the two respective faces of the film-shaped substrate 3*a* at positions distant from the image carrier 2. The writing electrodes 3*b* that are more distant from the tip end of the film-shaped substrate 3*a* than the writing electrodes 3*b*′ and are connected to the first driver 11 via wiring portions 9 that are formed on the first face of the film-shaped substrate 3*a*. The tip-side writing electrodes 3*b*′ are connected to the second driver 11' via wiring portions 9' that are formed on the tip end face and the second face of the film-shaped substrate 3*a*. This embodiment is effective in cost reduction because no through holes are formed.

In this embodiment, since the original film-shaped substrate 3*a* is folded and the resulting inside surfaces are bonded to each other, the elastic force of the film-shaped substrate 3*a* can further be stabilized.

A manufacturing method of the writing head according to the fifth embodiment will be described below with reference to FIGS. 12A and 12B.

Figure 12A:
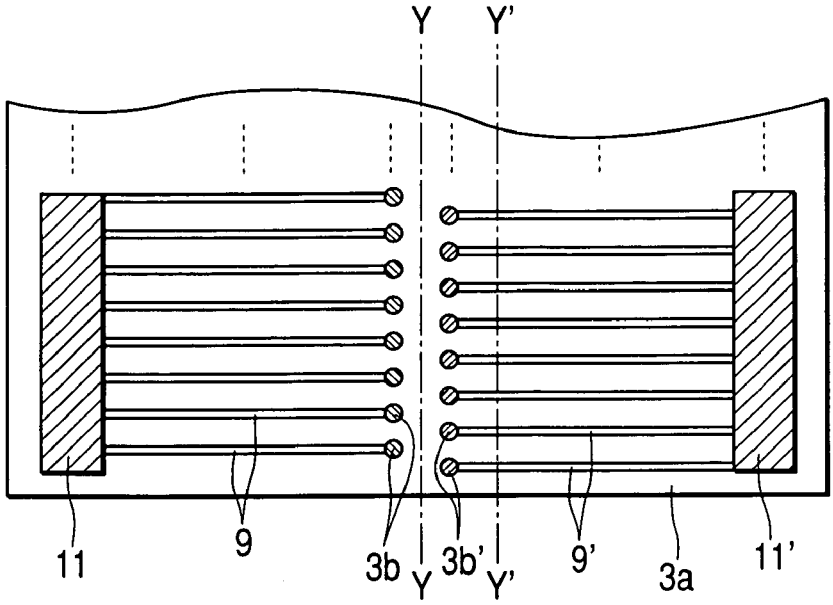
FIGS. 12A and 12B are plan view illustrating a manufacturing method of the writing head of FIG. 11.

As shown in FIG. 12A, two arrays of writing electrodes 3*b* and 3*b′* are formed on one surface of an original film-shaped substrate 3*a* in such a manner that the writing electrodes 3*b*, 3*b′* are opposed to each other at both sides of a line Y—Y which is parallel with the axial direction of the image carrier 2. Wiring portions 9 and 9' are formed in the direction perpendicular to the line Y—Y so as to be electrically connected to the writing electrodes 3*b* and 3*b′*. Drivers 11 and 11' are disposed on the original film-shaped substrate 3*a* at both longitudinal end positions, and the writing electrodes 3*b* and 3*b′* are electrically connected to the drivers 11 and 11' via the wiring portions 9 and 9', respectively.

Figure 12B:
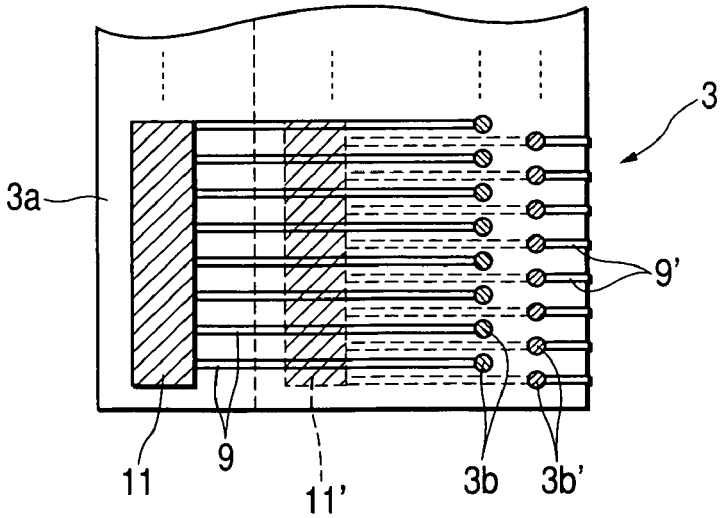

Then, as shown in FIG. 12B, the film-shaped substrate 3*a* is folded along a folding line Y'—Y' so that the two arrays of writing electrodes 3*b* and 3*b′* are located on the first face of a resulting film-shaped substrate 3*a*, whereby the writing head 3 of FIG. 11 is obtained.

In this embodiment, the writing electrodes 3*b* and 3*b′* are formed on the first face of the film-shaped substrate 3*a* and the wiring portions 9 and 9' corresponding to the writing electrodes 3*b* and 3*b′* are formed on both faces of the film-shaped substrate 3*a*. Therefore, current crosstalk can be prevented and the wiring portions 9 and 9' can be arranged densely on both faces of the film-shaped substrate 3*a*, thereby stabilizing the elastic force of the film-shaped substrate 3*a*.

Figure 13A:
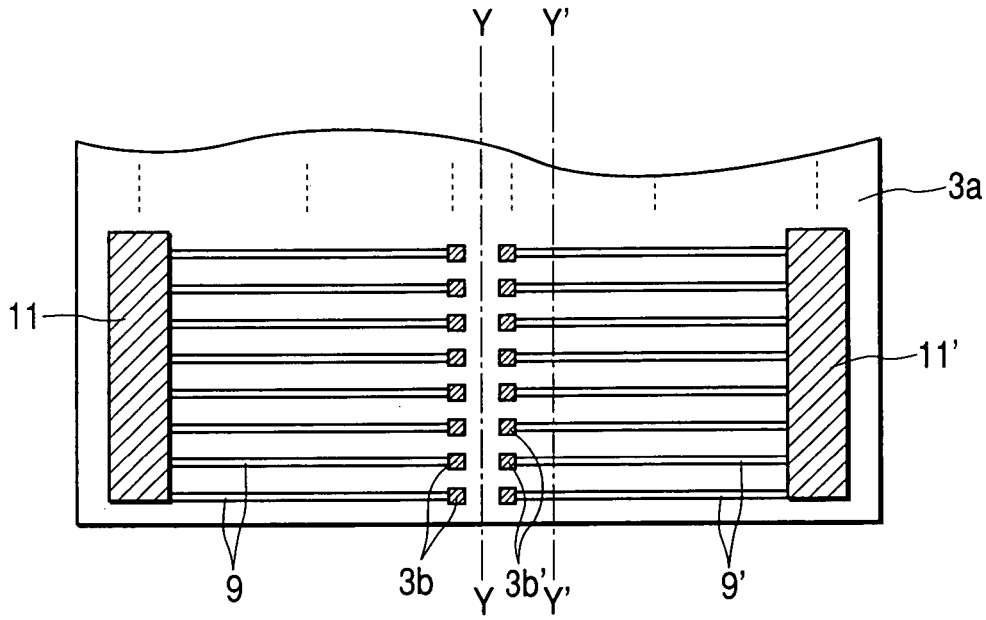
FIG. 13A is a plan view of a first modification of the writing head of FIG. 11.

FIG. 13A shows a first modification of the fifth embodiment. In this modification, the writing electrodes 3*b* and 3*b′* have rectangular shapes and the writing electrode 3*b* and the writing electrode 3*b′* of each pair are aligned in the moving direction of the image carrier 2. Gradation control is enabled by turning on one or both of writing voltages for those writing electrodes 3*b* and 3*b′*.

Figure 13B:
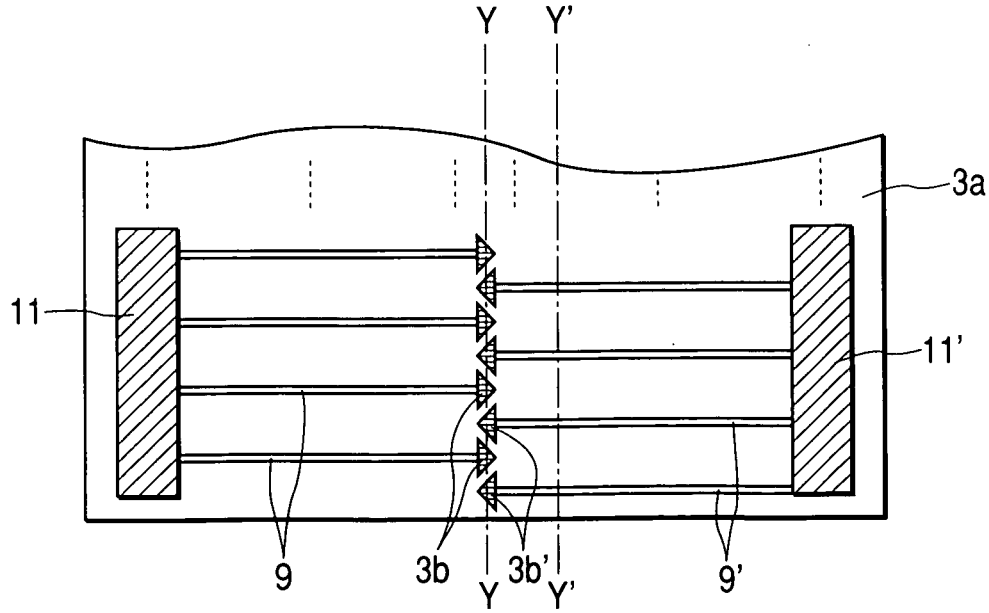
FIG. 13B is a plan view of a second modification of the writing head of FIG. 11.

FIG. 13B shows a second modification of the fifth embodiment. In this modification, the writing electrodes 3*b* and 3*b′* have triangular shapes and the writing electrodes 3*b* of the first array and the writing heads 3*b′* of the second array are alternately arranged.

Figure 14A:
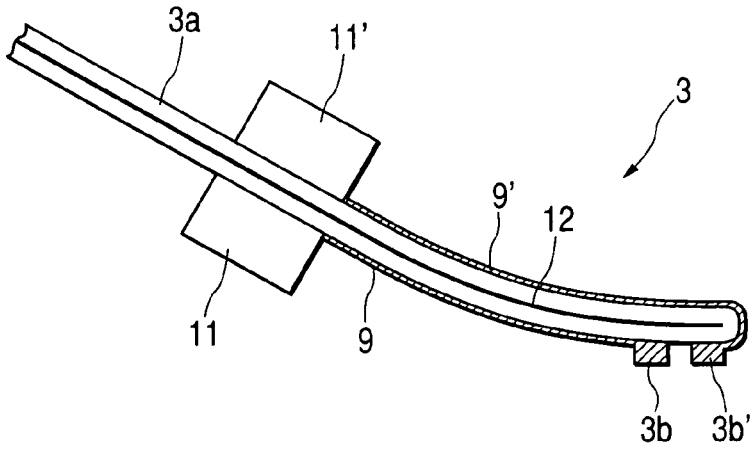
FIG. 14A is a side sectional view of a third modification of the writing head of FIG. 11.

FIG. 14A shows a third modification of the fifth embodiment. In this modification, an original film-shaped substrate 3 is folded after an adhesive is applied to its entire back face and the two parts of the back face are bonded to each other. This makes it possible to stabilize the elastic force when the writing head 3 is brought into contact with the image carrier 2.

Figure 14B:
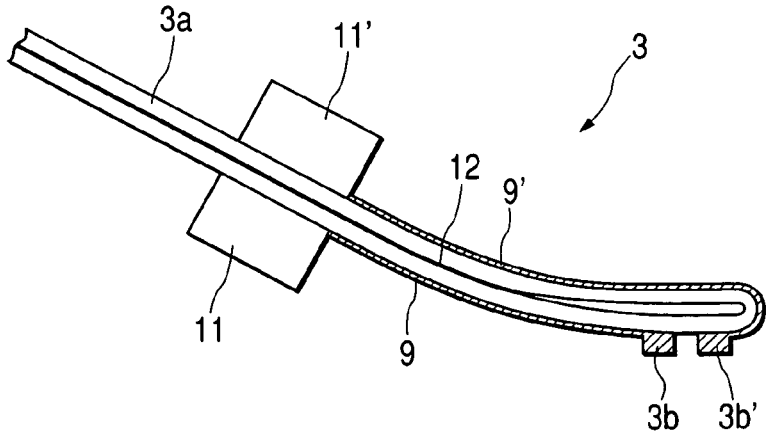
FIG. 14B is a side sectional view of a fourth modification of the writing head of FIG. 11.

FIG. 14B shows a fourth modification of the fifth embodiment. In this modification, an original film-shaped substrate 3 is folded after an adhesive is applied to its entire back face excluding a portion opposed to the writing electrodes 3*b* and 3*b′* and the two adhesive-applied parts of the back face are bonded to each other. This modification can increase the elasticity of the tip portion of a resulting film-shaped substrate 3*a* where the writing electrodes 3*b* and 3*b′* are formed because the tip end portion of the resulting film-shaped substrate 3*a* is loosely curved.

Figure 15:
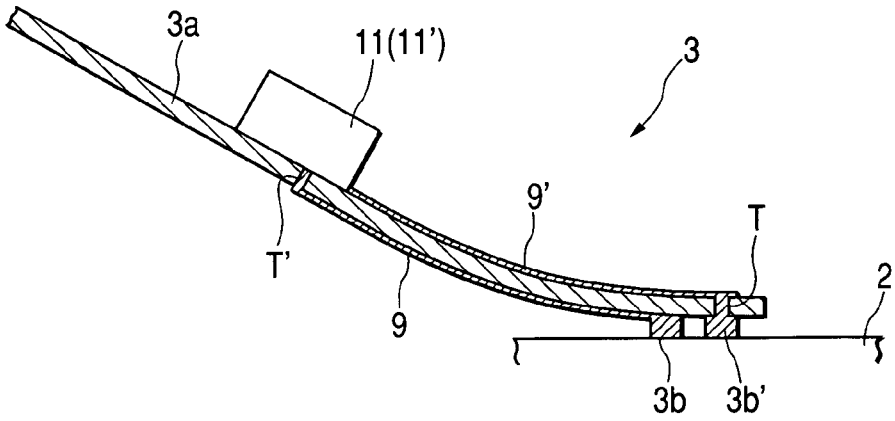
FIG. 15 is a side sectional view of a writing head according to a sixth embodiment of the invention.

FIG. 15 shows a writing head 3 according to a sixth embodiment of the invention. In each of the above embodiments, the drivers 11 and 11' are disposed on both faces of a film-shaped substrate 3*a*. In this embodiment, drivers 11 and 11' are disposed on the second face of the film-shaped substrate 3*a* and wiring portions 9 that are formed on the first face are connected to the first driver 11 via through holes T'.

Figure 16:
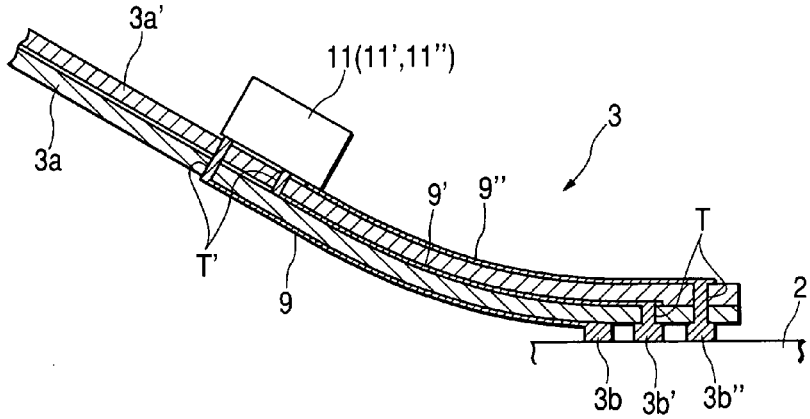
FIG. 16 is a side sectional view of a writing head according to a seventh embodiment of the invention.

FIG. 16 shows a writing head 3 according to a seventh embodiment of the invention. In this embodiment, film-shaped substrates 3*a* and 3*a′* are laminated to each other and wiring portions 9, 9', and 9" are provided in three layers. Three arrays of writing electrodes 3*b*, 3*b′* and 3*b″* are formed on a tip end portion of the first face of the film-shaped substrate 3*a* so as to be separated from each other in the secondary scanning direction (i.e., the moving direction of the image carrier 2). The writing electrodes 3*b*, 3*b′*, or 3*b″* of each array are arranged in the primary scanning direction (i.e., parallel with the axial direction of the image carrier 2). As in the embodiment of FIG. 15, drivers 11, 11', and 11" are fixed to the second face of the film-shaped substrate 3*a′*. The writing electrodes 3*b* that are more distant from the tip end of the film-shaped substrate 3*a* than the writing electrodes 3*b′* and 3*b″* are connected to the first driver 11 via the wiring portions 9 that are formed on the first face of the film-shaped substrate 3*a* and through holes T'. The middle writing electrodes 3*b′* are electrically connected to the second driver 11' via conductive members in through holes T of the film-shaped substrate 3*a*, the wiring portions 9' that are formed on the second face of the film-shaped substrate 3*a*, and through holes T'. The tip-side writing electrodes 3*b″* are electrically connected to the third driver 11" via conductive members in through holes T of the film-shaped substrates 3*a* and 3*a′* and wiring portions 9' that are formed on the second face of the film-shaped substrate 3*a′*.

Figure 17:
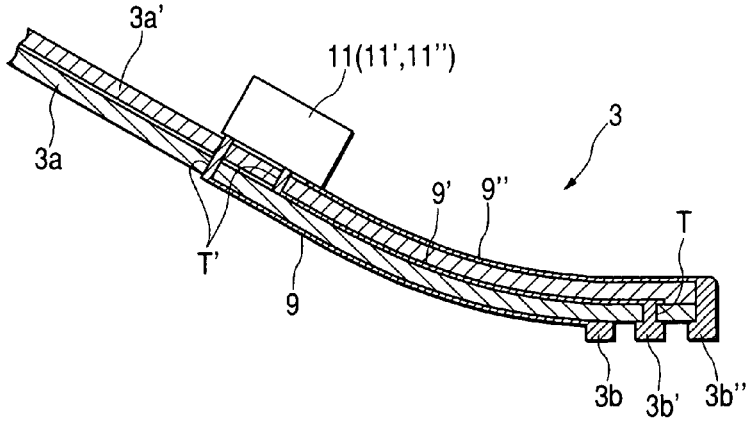
FIG. 17 is a side sectional view of a writing head according to an eighth embodiment of the invention.

FIG. 17 shows a writing head 3 according to an eighth embodiment of the invention. This embodiment is different from the seventh embodiment in that the tip-side writing electrodes 3*b″* are connected to the third driver 11" via the tip end faces of the film-shaped substrates 3*a* and 3*a′* and the wiring portions 9" that are formed on the second face of the film-shaped substrate 3*a′*.

The invention is not limited to the above embodiments and various modifications are possible. For example, although in the above embodiments the one or two film-shaped substrates are used and the wiring portions are provided in two or three layers, three or more film-shaped substrates may be used and wiring portions may be provided in four or more layers.

Figure 18:
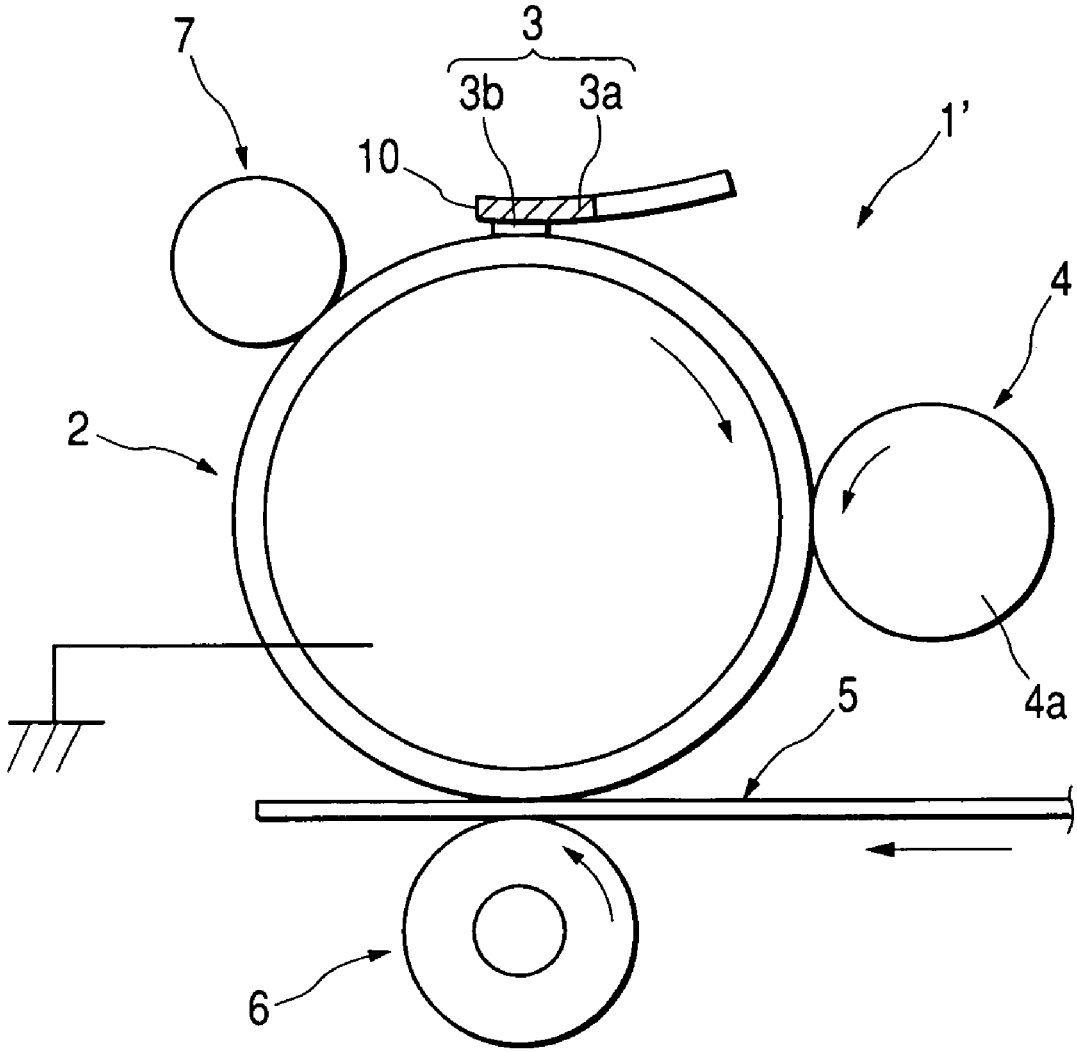
FIG. 18 is a schematic diagram showing a second example of an image forming apparatus according to the invention.

FIG. 18 shows a second example of an image forming apparatus according to the invention. This image forming apparatus is different from the image forming apparatus of FIG. 1A in that the former is equipped with a uniform charge controller 7. The other members in FIG. 18 are given the same reference symbols as in FIG. 1A and will not be described in detail. The uniform charge controller 7 is to perform a control to establish a uniform charge distribution state on the surface of the latent image carrier 2 by removing charge remaining on the surface of the latent image carrier 2 after an image transfer or charging the latent image carrier 2 after an image transfer.

Figure 19A:
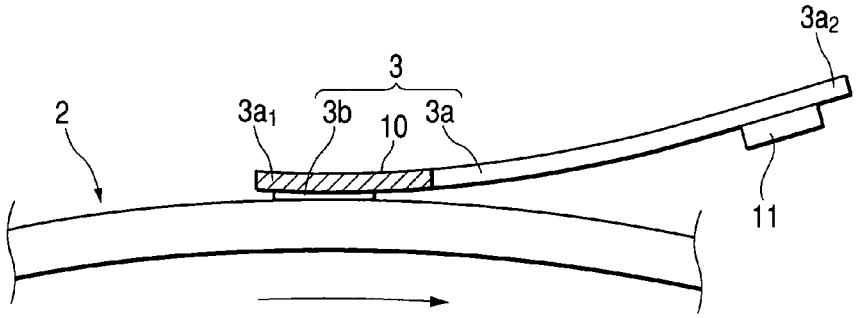
FIGS. 19A and 19B are enlarged views of writing heads as viewed parallel with the axial direction of a latent image carrier.

In the writing head 3, for example, as shown in FIG. 19A, writing electrodes 3*b* are formed on a tip end portion $3a_1$ of a support substrate 3*a* and an end portion $3a_2$ of the support substrate 3*a* that is located on the side opposite to the writing electrodes 3*b* is fixed by a proper fixing member. A driver 11 for controlling the operation of the writing electrodes 3*b* is fixed to the end portion $3a_2$ of the support substrate 3*a*. A reinforcing member 10 for increasing the rigidity in the primary scanning direction (i.e., in the direction parallel with the axial direction of the latent image carrier 2) is integral with the flexible support substrate 3*a*. The writing electrodes 3*b* write an electrostatic latent image being pressed weakly against the surface of the image carrier 2 by elastic restoration force that is produced by the flexed support substrate 3*a*.

Figure 19B:
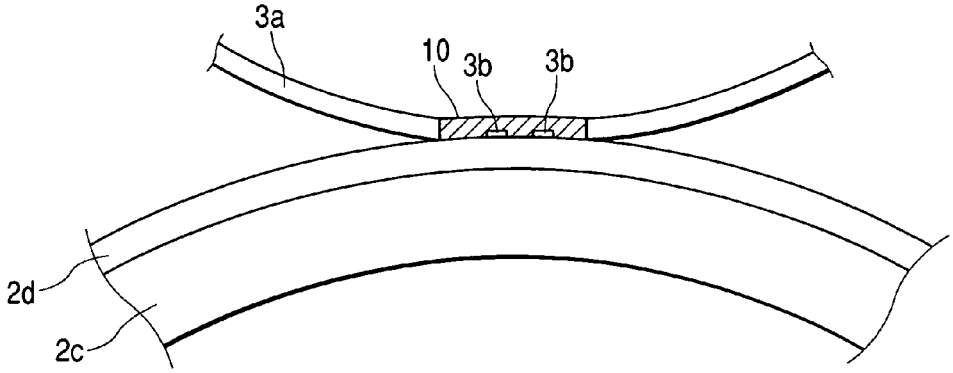

In another writing head 3 shown in FIG. 19B, writing electrodes 3*b* have rectangular shapes and two arrays of writing electrodes 3*b* are arranged in the secondary scanning direction (i.e., the circumferential direction of the latent image carrier 2). Both end portions of a support substrate 3*a* are fixed to fixing members.

In either case, since a plurality of writing electrodes 3*b* are arranged parallel with the axial direction of the latent image carrier 2 (i.e., in the primary scanning direction), the support substrate 3*a* assumes a rectangular-plate-shaped shape whose length is approximately equal, in the axial direction of the latent image carrier 2, to the length of the independent electrode portion 2*d* of the latent image carrier 2. The reinforcing member 10 prevents local low-rigidity regions from occurring between the writing electrodes 3*b* or wiring patterns and thereby allows the writing electrodes 3*b* to contact the latent image carrier stably. The reinforcing member 10 also prevents waving or wrinkling of the writing head 3. In FIG. 19A, the support substrate 3*a* extends right to left, that is, in the direction opposite to the rotation direction of the latent image carrier 2 (clockwise; indicated by an arrow).

In the states of FIGS. 19A and 19B, the support substrate 3*a* is somewhat flexed elastically and thereby produces weak elastic restoration force, whereby the writing electrodes 3*b* are pressed against the latent image carrier 2 by weak pressing force and thereby brought in contact with the latent image carrier 2. Since the force of pressing the writing electrodes 3*b* against the latent image carrier 2 is weak, the abrasion of the independent electrode portion 2*d* of the latent image carrier 2 by the writing electrodes 3*b* is suppressed and the durability of the independent electrode portion 2*d* is thereby increased. Further, since the writing electrodes 3*b* are brought in contact with the independent electrode portion 2*d* by the elastic force of the support substrate 3*a,* the contact is stable.

Figure 20A:
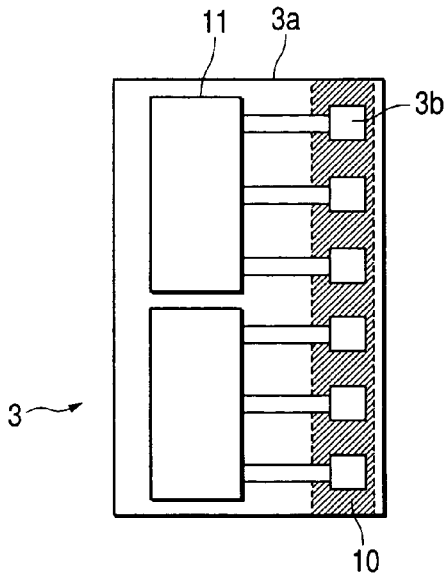
FIG. 20A is a plan view of a writing head according to a ninth embodiment of the invention.

FIG. 20A shows a writing head 3 according to a ninth embodiment of the invention. In this embodiment, writing electrodes 3*b* are arrayed and a backside reinforcing member 10 is integral with at least a writing electrode forming portion of a support substrate 3*a* that covers all the writing electrodes 3*b*. The reinforcing member 10 may be made of either an insulative material or a conductive material, and may be an elastic material such as PET or polyimide or a metal material such as stainless steel or copper. As a further alternative, a tape of conductive foil or metal foil may be stuck to the support substrate 3*a*. In a case where the reinforcing member 10 has a shape as same as wiring patterns of the writing head 3, the reinforcing member 10 can be formed by using a mask at the same time as the wiring patterns of the writing head 3 are formed. Therefore, no step of forming the reinforcing member 10 later is needed and the productivity is improved accordingly.

Figure 20B:
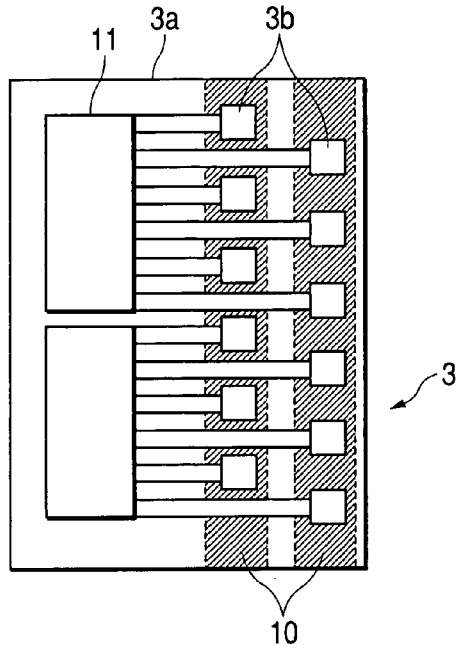
FIG. 20B is a plan view of a first modification of the writing head of FIG. 20A.
Figure 20C:
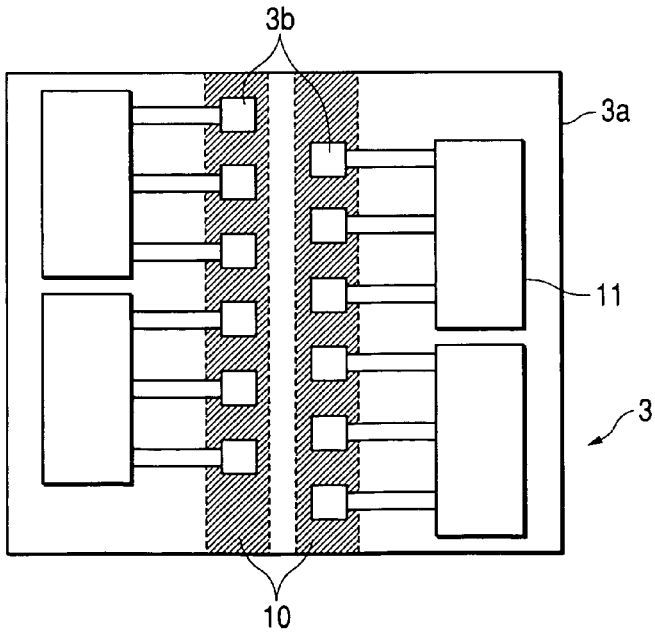
FIG. 20C is a plan view of a second modification of the writing head of FIG. 20A.

Instead of arranging the writing electrodes 3*b* in line, plural lines of writing electrodes 3*b* may be arranged in the secondary scanning direction. For example, FIG. 20B shows an example in which two arrays of writing electrodes 3*b* are arranged in the secondary scanning direction in such a manner that the writing electrodes 3*b* are staggered and drivers 11 are disposed on one side of the two arrays of writing electrodes 3*b*. FIG. 20C shows an example in which two arrays of writing electrodes 3*b* are arranged in the secondary scanning direction in such a manner that the writing electrodes 3*b* are staggered and drivers 11 are disposed on both sides of the two arrays of writing electrodes 3*b*.

Figure 21A:
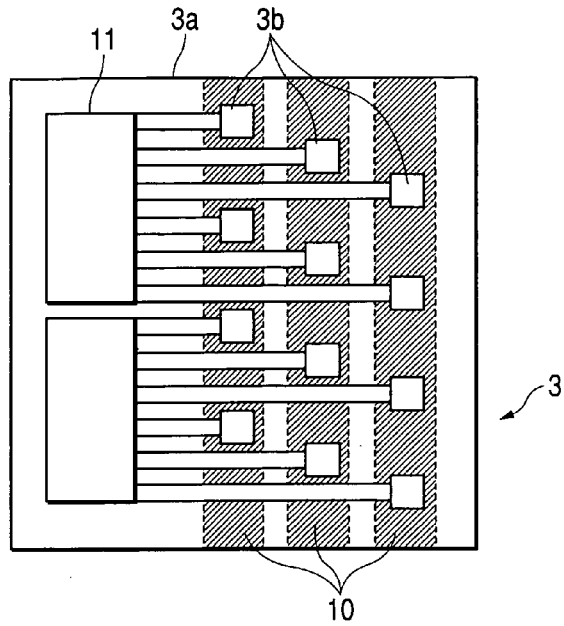
FIG. 21A is a plan view of a third modification of the writing head of FIG. 20A.
Figure 21B:
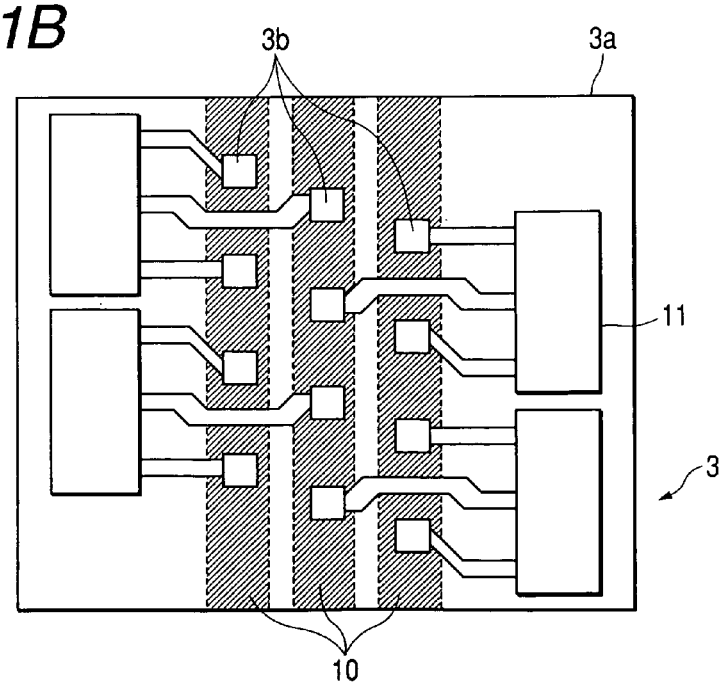
FIG. 21B is a plan view of a fourth modification of the writing head of FIG. 20A.
Figure 22A:
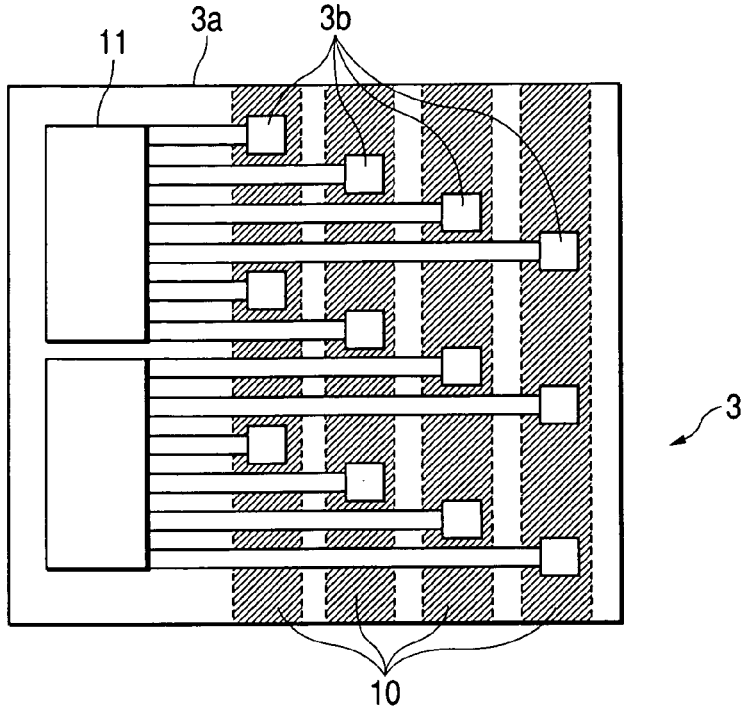
FIG. 22A is a plan view of a fifth modification of the writing head of FIG. 20A.
Figure 22B:
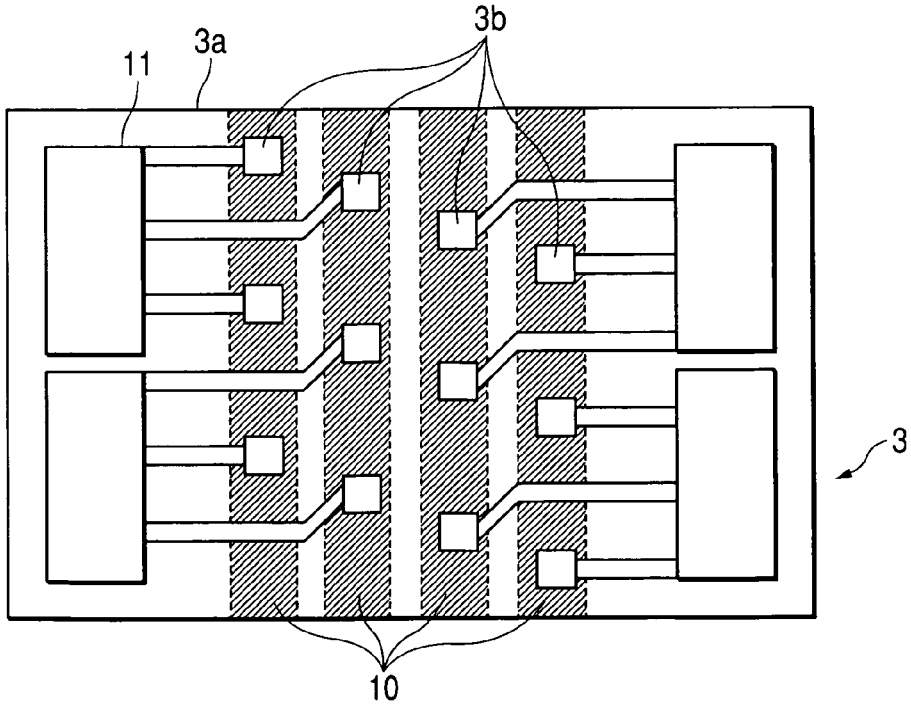
FIG. 22B is a plan view of a sixth modification of the writing head of FIG. 20A.

FIG. 21A shows an example in which three arrays of writing electrodes 3*b* are arranged in the secondary scanning direction in such a manner that the writing electrodes 3*b* of the three arrays are not aligned in the secondary scanning direction, and drivers 11 are disposed on one side of the three arrays of writing electrodes 3*b*. FIG. 21B shows an example in which drivers 11 are disposed on both sides of three arrays of writing electrodes 3*b* in the secondary scanning direction. FIGS. 22A and 22B show similar arrangement examples in which four arrays of writing electrodes 3*b* are arranged in the secondary scanning direction. Reinforcing members 10 are formed for the respective lines of writing electrodes 3*b* in such a manner that each reinforcing member 3*b* covers all the associated writing electrodes 3*b*.

Figure 23A:
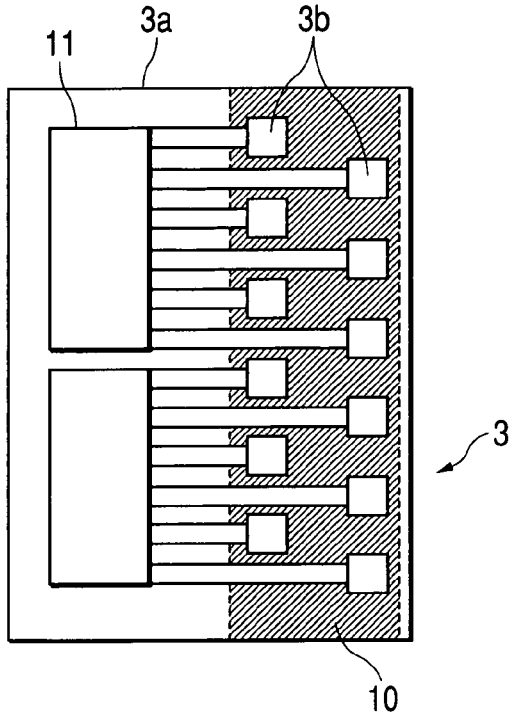
FIG. 23A is a plan view of a seventh modification of the writing head of FIG. 20A.
Figure 23B:
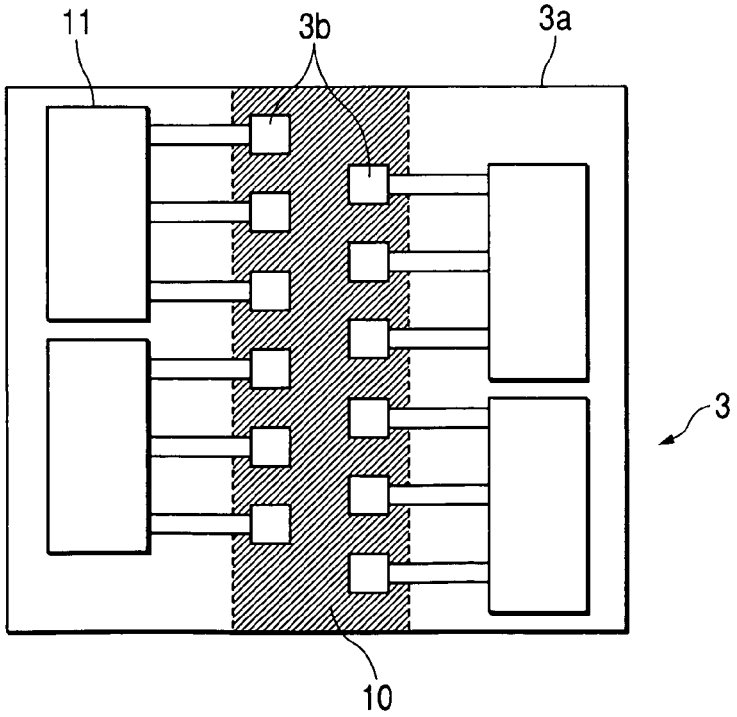
FIG. 23B is a plan view of an eighth modification of the writing head of FIG. 20A.

Since as described above the reinforcing member 10 or each of the reinforcing members 10 is integrally formed so as to cover all the writing electrodes 3*b* of each array, the portions between the writing electrodes 3*b* and the portions between the wiring patterns where the rigidity is much lower than in the portions of the writing electrodes 3*b* and the wiring patterns can be reinforced. Therefore, waving or wrinkling of the writing head 3 in the primary scanning direction is prevented and hence the writing electrodes 3*b* can stably be brought in contact with the latent image carrier 2. As a result, an electrostatic latent image can be formed correctly on the latent image carrier 2 and the print quality can thereby be improved.

Where plural lines of writing electrodes 3*b* are arranged in the secondary scanning direction, the reinforcing member 10 may be formed so as to cover all the arrays of writing electrodes 3*b*. FIGS. 23A and 23B show examples in which the reinforcing member 10 is formed so as to cover both arrays of writing electrodes 3*b* arranged in the secondary scanning direction. In the example of FIG. 23A, the drivers 11 are disposed on one side of the two arrays of writing electrodes 3*b* in the secondary scanning direction. In the example of FIG. 23B, the drivers 11 are disposed on both sides of the two arrays of writing electrodes 3*b* in the secondary scanning direction.

Figure 24A:
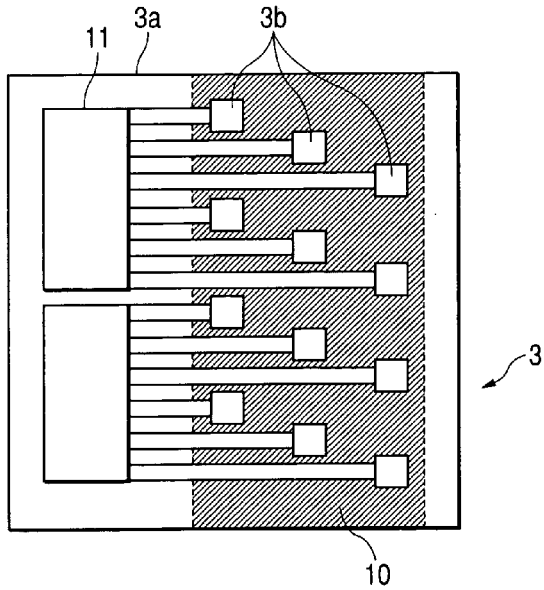
FIG. 24A is a plan view of a ninth modification of the writing head of FIG. 20A.
Figure 24B:
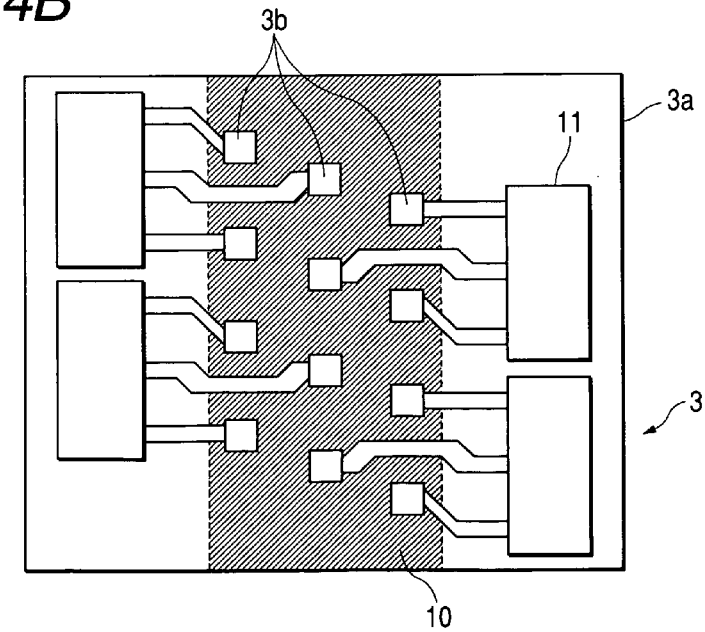
FIG. 24B is a plan view of a tenth modification of the writing head of FIG. 20A.

FIGS. 24A and 24B show examples in which the reinforcing member 10 is formed so as to cover all the three arrays of writing electrodes 3*b* arranged in the secondary scanning direction. In the example of FIG. 24A, the drivers 11 are disposed on one side of the three arrays of writing electrodes 3*b* in the secondary scanning direction. In the example of FIG. 24B, the drivers 11 are disposed on both sides of the three arrays of writing electrodes 3*b* in the secondary scanning direction.

Figure 25A:
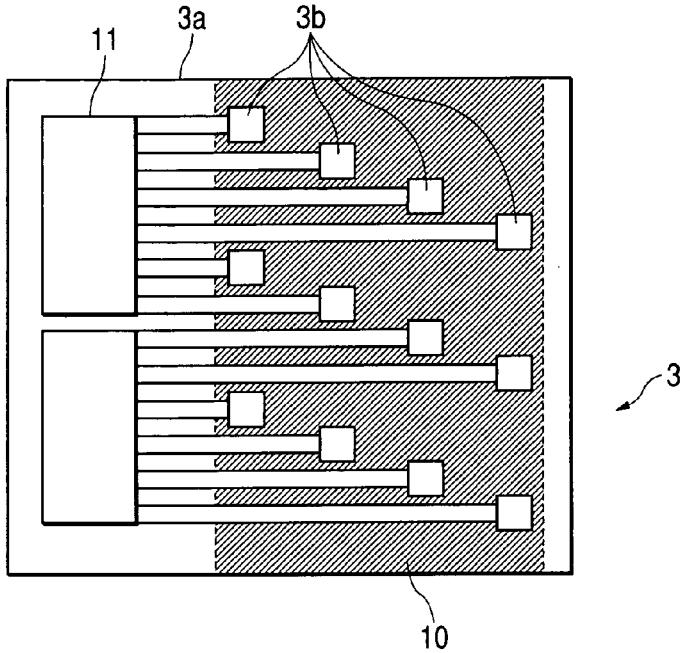
FIG. 25A is a plan view of an eleventh modification of the writing head of FIG. 20A.
Figure 25B:
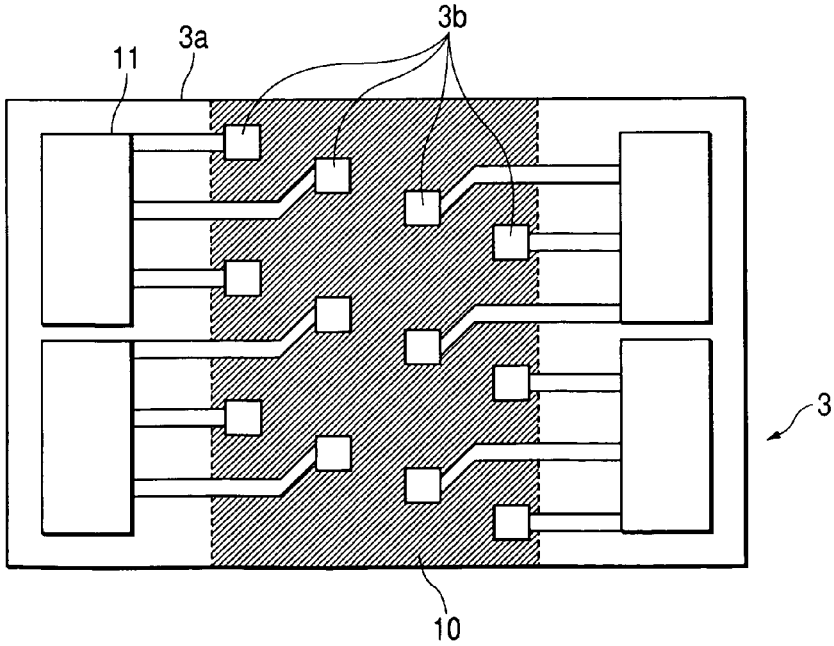
FIG. 25B is a plan view of a twelfth modification of the writing head of FIG. 20A.

FIGS. 25A and 25B show examples in which the reinforcing member 10 is formed so as to cover all the four arrays of writing electrodes 3*b* arranged in the secondary scanning direction. In the example of FIG. 25A, the drivers 11 are disposed on one side of the four arrays of writing electrodes 3*b* in the secondary scanning direction. In the example of FIG. 25B, the drivers 11 are disposed on both sides of the four arrays of writing electrodes 3*b* in the secondary scanning direction.

Since as described above the reinforcing member 10 is formed so as to be to cover all the arrays of writing electrodes 3*b* arranged in the secondary scanning direction, the portions that are located between the arrays of the writing electrodes 3*b* arranged in the secondary scanning direction and in which no wiring patterns exist and hence the rigidity is much lower than in the other portions can be reinforced. Therefore, stress concentration and folding of the writing head 3 is prevented there and hence the lines of writing electrodes 3*b* can be brought in contact with the latent image carrier 2 equally and stably. As a result, an electrostatic latent image can be formed correctly on the latent image carrier 2 and the print quality can thereby be increased. That is, a problem that horizontal streaks appear in an image because of a phenomenon that folding of the writing head 3 vary the distances between the lines of writing electrodes 3*b* to disorder the dot pitch of an electrostatic latent image can be solved.

Figure 26A:
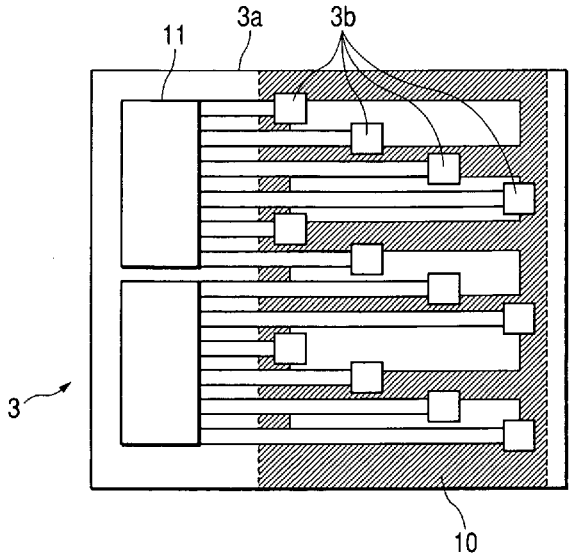
FIG. 26A is a plan view of a writing head according to a tenth embodiment of the invention.
Figure 26B:
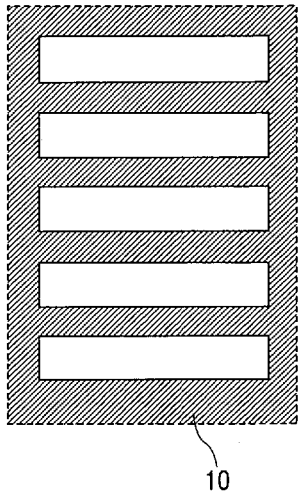
FIG. 26B is a plan view of a reinforcing member of the writing head of FIG. 26A.

FIG. 26A shows a writing head 3 according to a tenth embodiment of the invention. As shown in FIG. 26B, a reinforcing member 10 in this embodiment is a frame-shaped which surrounds a region where the writing electrodes 3*b* are formed in both of the primary and secondary scanning directions. In addition, patterns extending in the secondary scanning direction are arrayed in the intermediate portions of the frame in the primary scanning direction. Specifically, the patterns extending in the primary scanning direction prevent waving and wrinkling of the writing head 3 and the patterns extending in the secondary scanning direction reinforce the portions between the four arrays of writing electrodes 3*b*.

Figure 26C:
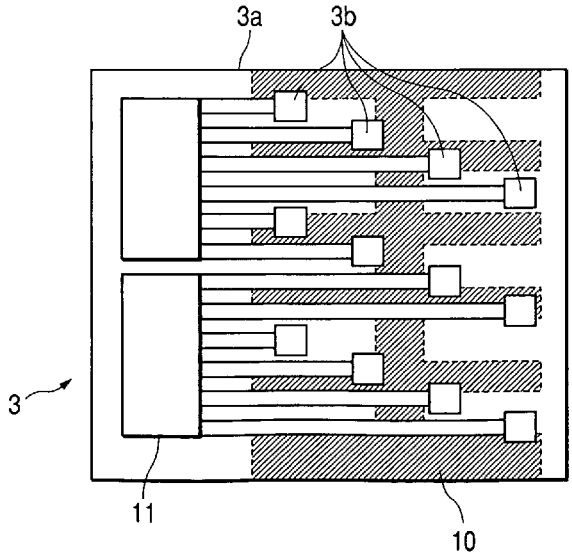
FIG. 26C is a plan view of a modification of the writing head of FIG. 26A.
Figure 26D:
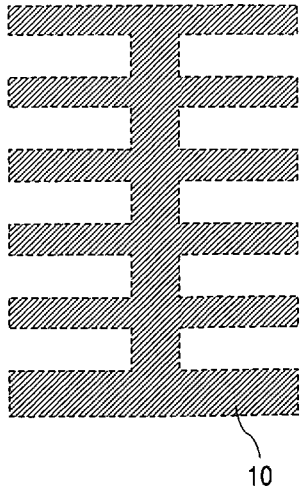
FIG. 26D is a plan view of a reinforcing member of the writing head of FIG. 26C.

FIGS. 26C and 26D show an example in which a reinforcing member 10 is composed of a pattern disposed at a center portion in the secondary scanning direction of the region where the writing electrodes 3*b* are formed and extending in the primary scanning direction, and a plurality of patterns extending from the central pattern to both ends of the region in the secondary scanning direction. The central pattern extending in the primary scanning direction attains reinforcement for preventing waving and wrinkling of the writing head 3.

In the writing head 3, the support substrate 3*a* is somewhat flexed elastically to produce weak elastic restoration force, whereby the writing electrodes 3*b* are brought into contact with the latent image carrier 2 by weak pressing force. Since the pressing force is weak, the abrasion of the charge-bearing layer 2*b* of the latent image carrier 2 by the writing electrodes 3*b* is suppressed and the durability of the charge-bearing layer 2*b* is thereby enhanced. Further, the writing electrodes 3*b* are brought in contact with the charge-bearing layer 2*b* stably by the elastic force of the support substrate 3*a*. However, since the reinforcing member 10 is formed on the back face that is opposite to the surface where the writing electrodes 3*b* are formed, the writing electrodes 3*b* may lower the elasticity to thereby increase the pressing force and hence the abrasion or to lower the stability of their contact to the charge-bearing layer 2*b*. To avoid this problem, the reinforcing member 10 may be formed in such a manner that the reinforcing member 10 is not opposed to the writing electrodes 3*b*.

Figure 27A:
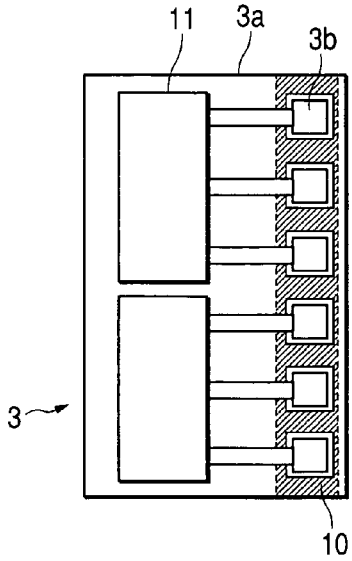
FIG. 27A is a plan view of a writing head according to an eleventh embodiment of the invention.
Figure 27B:
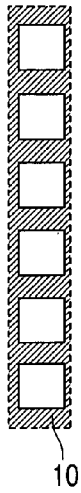
FIG. 27B is a plan view of a reinforcing member of the writing head of FIG. 27A.
Figure 27C:
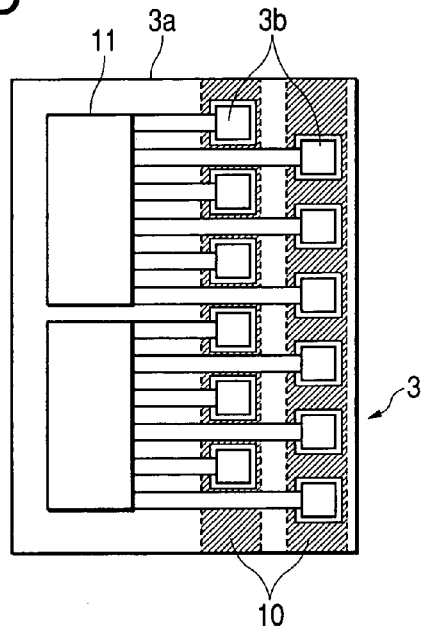
FIG. 27C is a plan view of a first modification of the writing head of FIG. 27A.
Figure 27D:
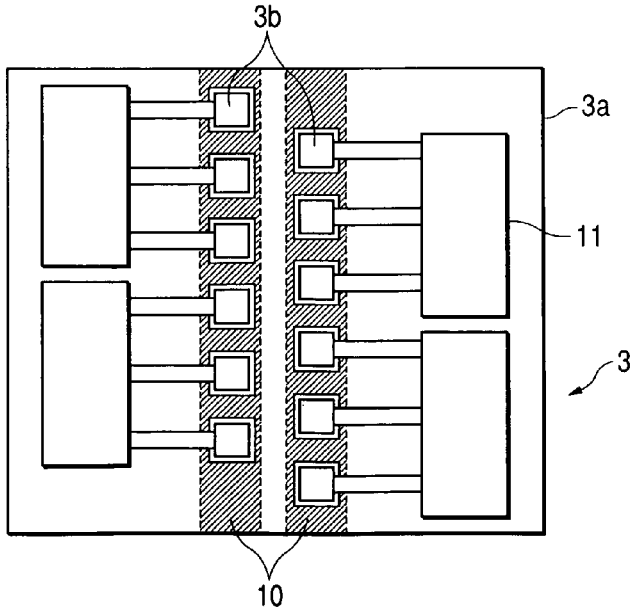
FIG. 27D is a plan view of a second modification of the writing head of FIG. 27A.

FIGS. 27A and 27B show a writing head 3 having such a reinforcing member 10 according to an eleventh embodiment of the invention. FIGS. 27C and 27D show writing heads 3 that correspond to the writing heads 3 of FIGS. 20B and 20C, respectively, and in which reinforcing member 10 are formed so as not to oppose to the writing electrodes 3*b*.

Figure 28A:
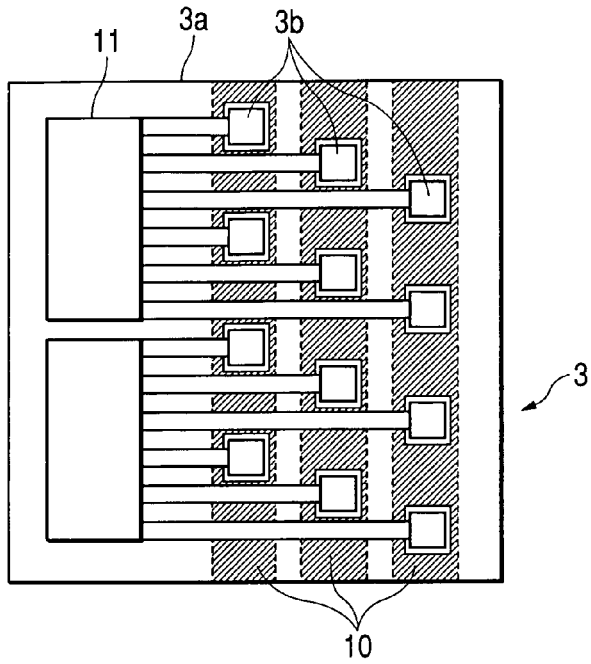
FIG. 28A is a plan view of a third modification of the writing head of FIG. 27A.
Figure 28B:
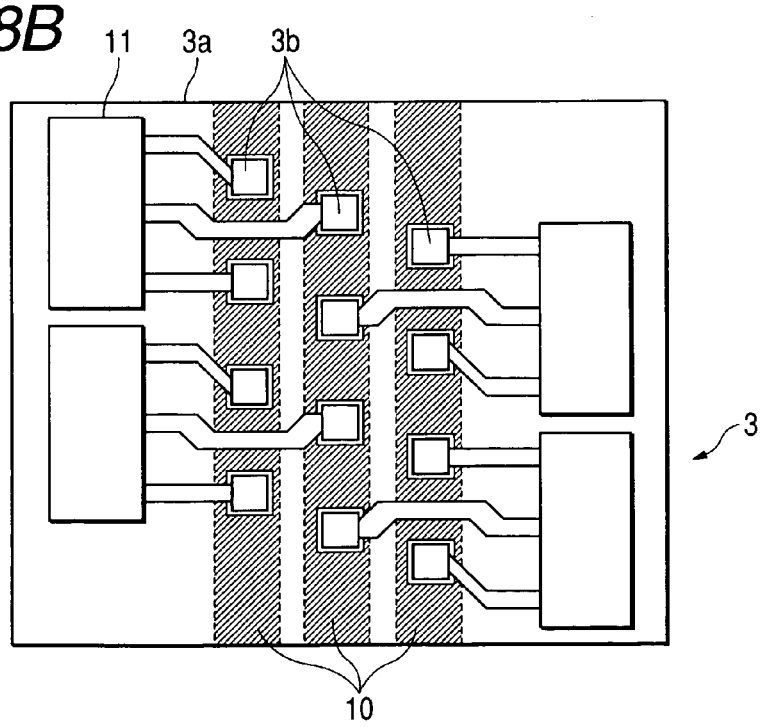
FIG. 28B is a plan view of a fourth modification of the writing head of FIG. 27A.

FIGS. 28A and 28B show writing heads 3 that correspond to the writing heads 3 of FIGS. 21A and 21B, respectively, and in which reinforcing member 10 are formed so as not to oppose to the writing electrodes 3*b*.

Figure 29A:
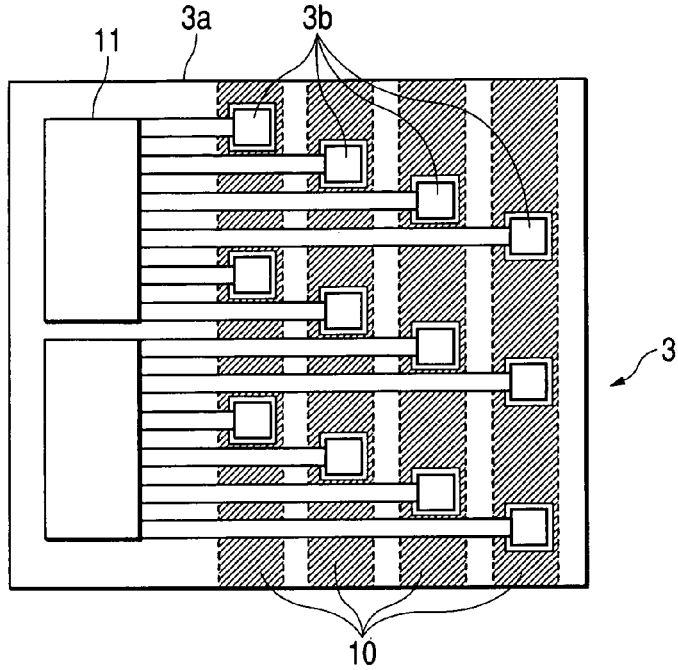
FIG. 29A is a plan view of a fifth modification of the writing head of FIG. 27A.
Figure 29B:
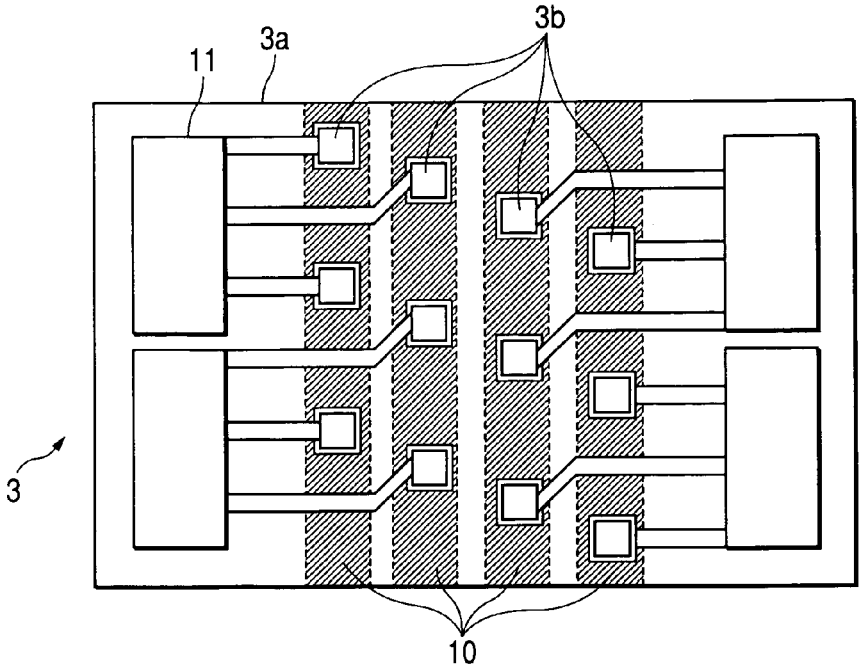
FIG. 29B is a plan view of a sixth modification of the writing head of FIG. 27A.

FIGS. 29A and 29B show writing heads 3 that correspond to the writing heads 3 of FIGS. 22A and 22B, respectively, and in which reinforcing member 10 are formed so as not to oppose to the writing electrodes 3*b*.

Figure 30A:
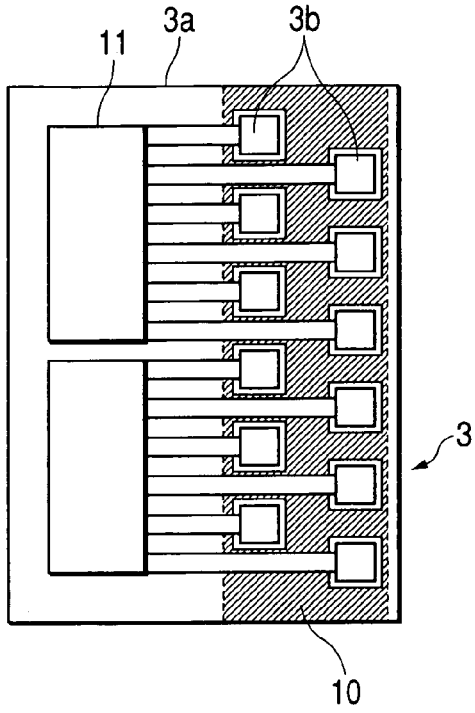
FIG. 30A is a plan view of a seventh modification of the writing head of FIG. 27A.
Figure 30B:
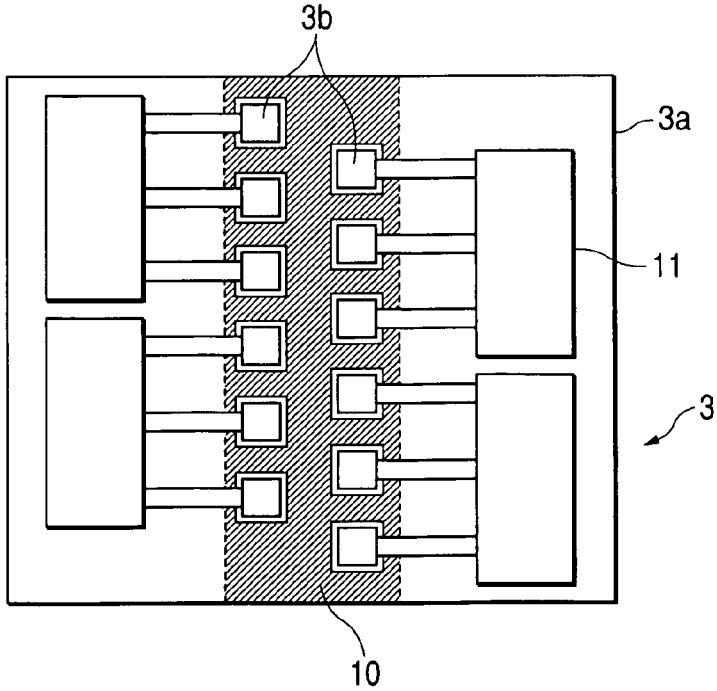
FIG. 30B is a plan view of an eighth modification of the writing head of FIG. 27A.

FIGS. 30A and 30B show writing heads 3 that correspond to the writing heads 3 of FIGS. 23A and 23B, respectively, and in which reinforcing member 10 are formed so as not to oppose to the writing electrodes 3*b*.

Figure 31A:
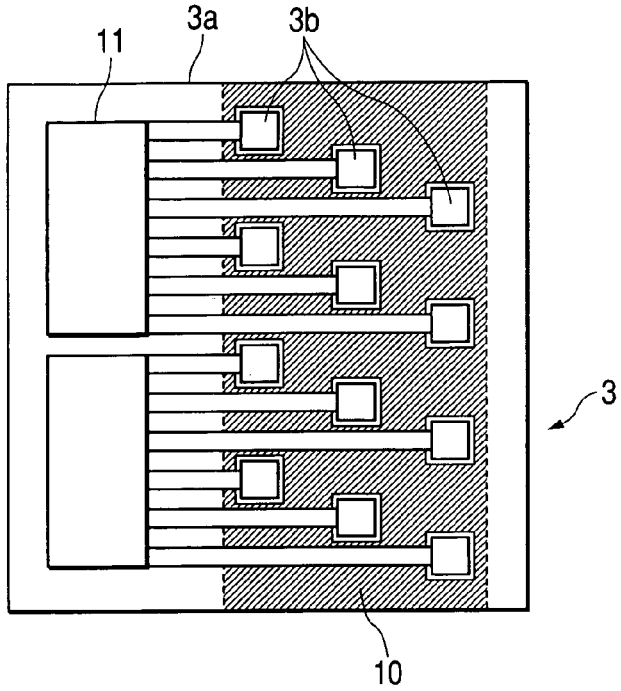
FIG. 31A is a plan view of a ninth modification of the writing head of FIG. 27A.
Figure 31B:
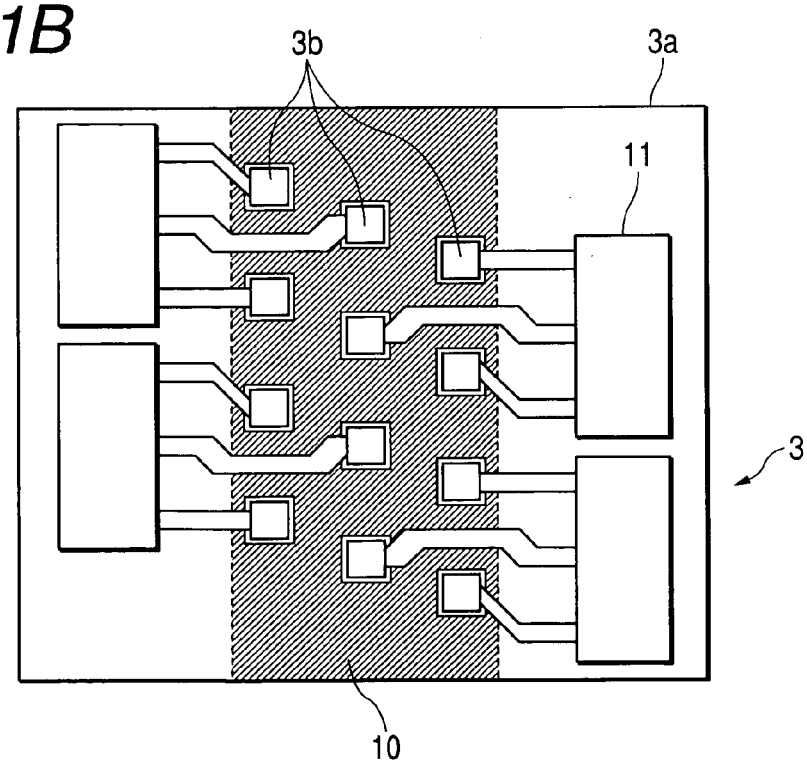
FIG. 31B is a plan view of a tenth modification of the writing head of FIG. 27A.

FIGS. 31A and 31B show writing heads 3 that correspond to the writing heads 3 of FIGS. 24A and 24B, respectively, and in which reinforcing member 10 are formed so as not to oppose to the writing electrodes 3*b*.

Figure 32A:
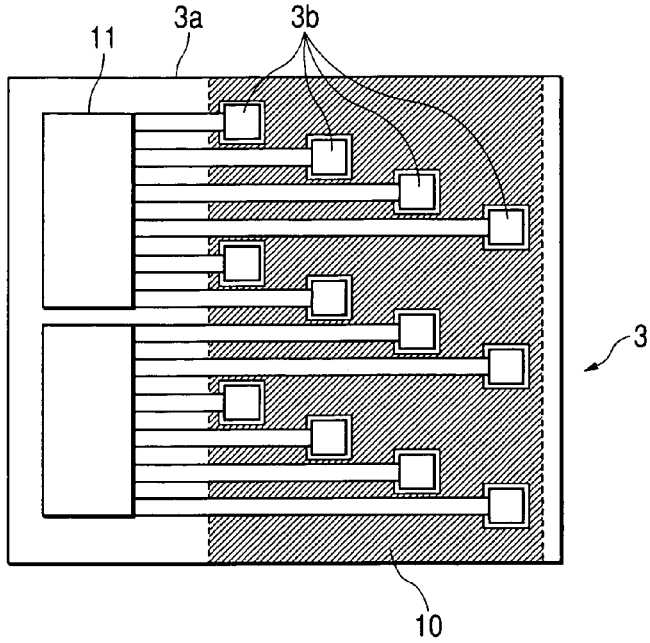
FIG. 32A is a plan view of an eleventh modification of the writing head of FIG. 27A.
Figure 32B:
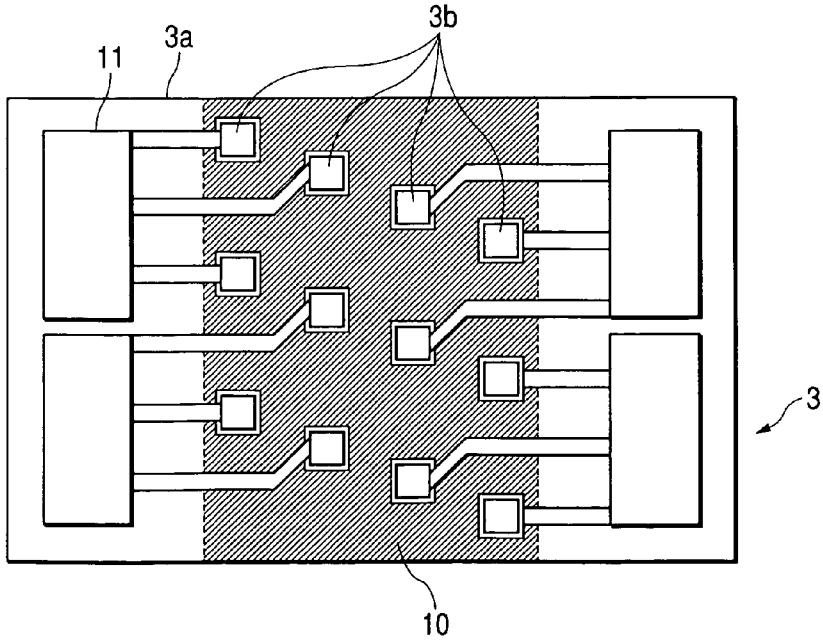
FIG. 32B is a plan view of a twelfth modification of the writing head of FIG. 27A.
Figure 33A:
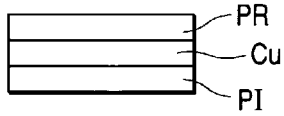
FIGS. 33A–33J are views for explaining a manufacturing method of the writing electrode according to the invention.
Figure 33B:
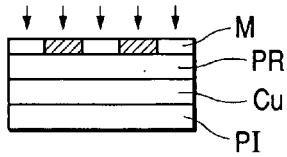
Figure 33C:
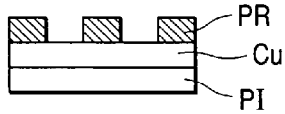
Figure 33D:
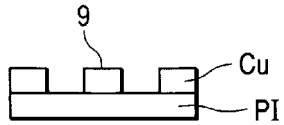
Figure 33E:
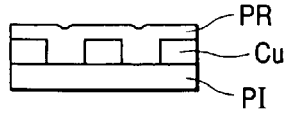
Figure 33F:
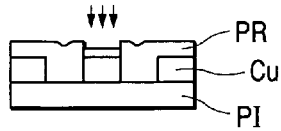
Figure 33G:
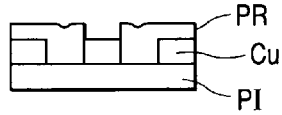
Figure 33H:
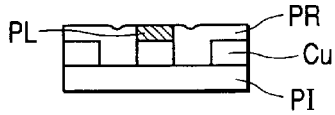
Figure 33I:
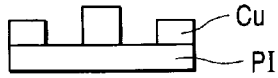
Figure 33J:
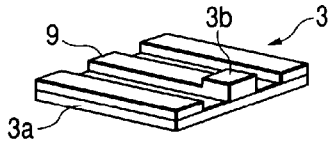
Figure 34A:
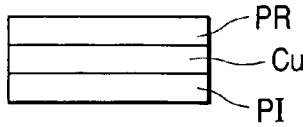
FIGS. 34A–34I are views for explaining a first modification of the manufacturing method of FIGS. 33A–33J.
Figure 34B:
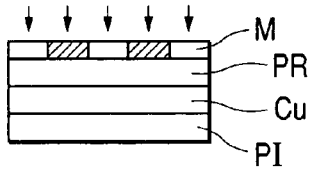
Figure 34C:
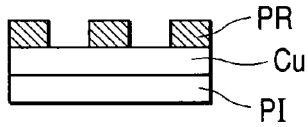
Figure 34D:
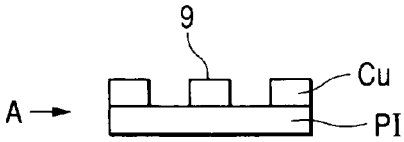
Figure 34E:
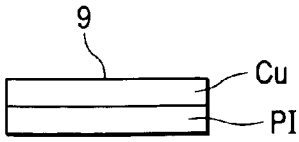
Figure 34F:
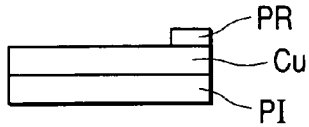
Figure 34G:
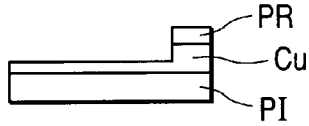
Figure 34H:
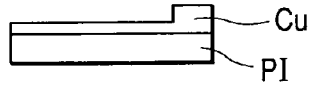
Figure 34I:
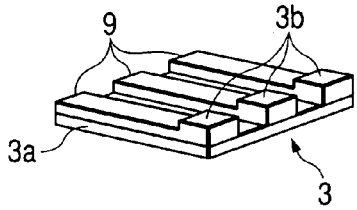
Figure 35A:
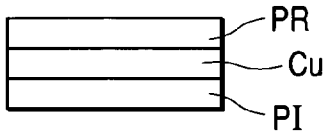
FIGS. 35A–35J are views for explaining a second modification of the manufacturing method of FIGS. 33A–33J.
Figure 35B:
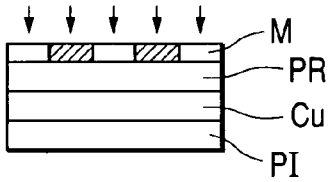
Figure 35C:
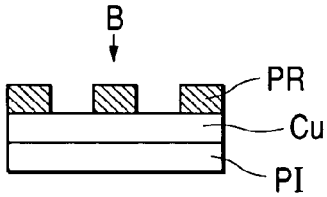
Figure 35D:
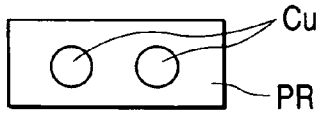
Figure 35E:
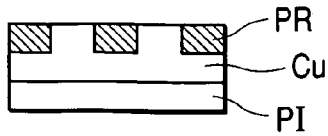
Figure 35F:
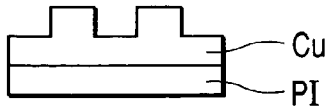
Figure 35G:
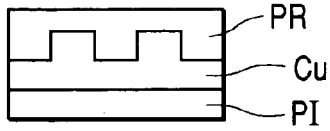
Figure 35H:
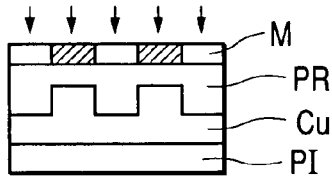
Figure 35I:
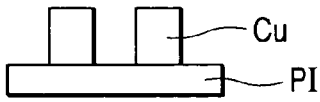
Figure 35J:
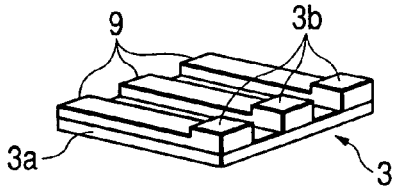
Figure 36:
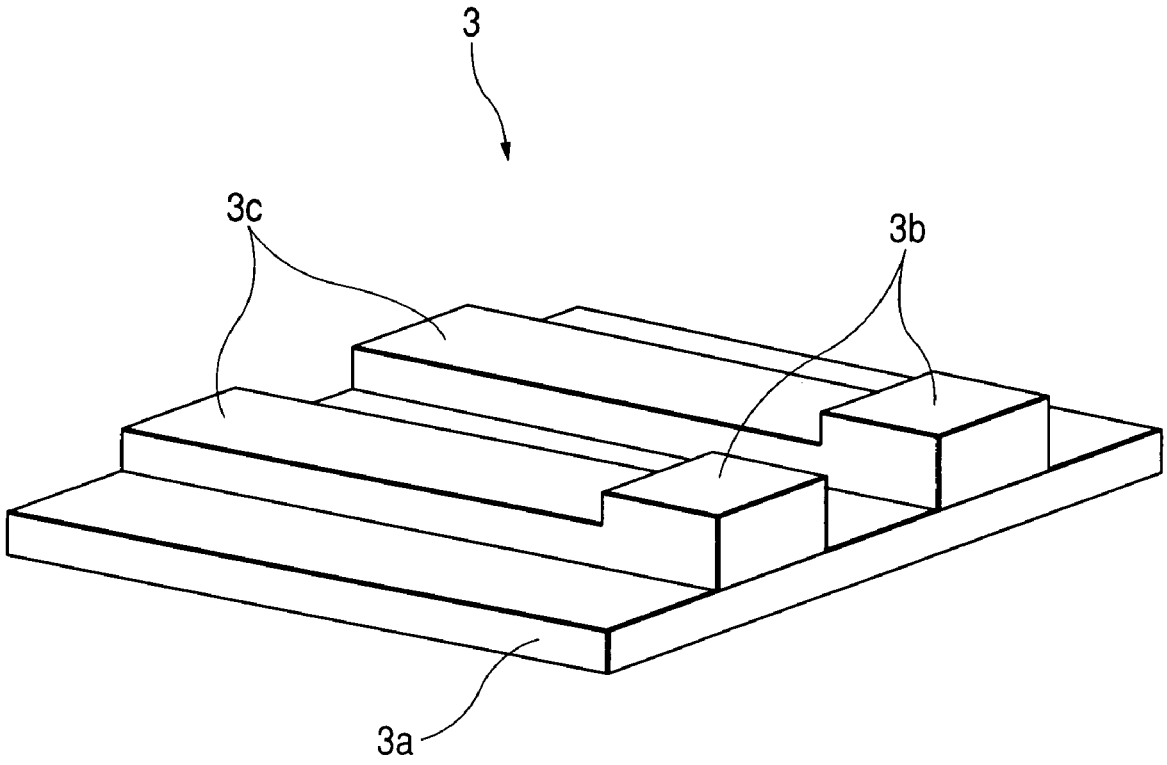
FIG. 36 is a perspective view of part of a related-art writing head.

FIGS. 32A and 32B show writing heads 3 that correspond to the writing heads 3 of FIGS. 25A and 25B, respectively, and in which reinforcing member 10 are formed so as not to oppose to the writing electrodes 3*b*.

The invention is not limited to the above embodiments and various modifications are possible. For example, although in the above embodiments the reinforcing member 10 made of an elastic such as PET or polyimide or a metal material such as stainless steel or copper is integral with the support substrate 3*a* or the corresponding portion of the support substrate 3*a* is made thicker than in the other portions, the strength of the support substrate 3*a* in the primary scanning direction (i.e., the direction parallel with the axial direction of the image carrier 2) may be made relatively higher by forming, in the support substrate 3*a,* slits extending in the secondary scanning direction, or strength anisotropy may be imparted to the support substrate 3*a* itself by draw molding. Although the above embodiments are directed to the writing heads 3 in which the reinforcing member 10 is formed on the surface of the support substrate 3*a* that is opposite to its surface on which the writing electrodes 3*b* are formed, the reinforcing member 10 may be formed on the surface on which the writing electrodes 3*b* are formed. In the latter case, naturally the reinforcing member 10 should be formed so as not to interfere with the writing electrodes 3*b*.

FIGS. 33A–33J illustrate a writing electrode manufacturing method according to the invention. First, metal foil Cu is laid on one surface of an insulative member (corresponds to a film-shaped substrate 3*a*) PI and a photoresist PR is applied to the top surface of the metal foil Cu (see FIG. 33A). The photoresist PR is covered with a mask M that is formed with wiring patterns, and is then exposed to light (see FIG. 33B). Light-exposed portions of the photoresist PR are etched away (see FIG. 33C). Then, wiring portions 9 are formed by etching away the exposed portions of the metal foil Cu (see FIG. 33D). After another photoresist PR is applied to the entire surface (see FIG. 33E), holes are formed through the photoresist PR by laser light illumination in regions where to form writing electrodes (see FIGS. 33F and 33G). Then, metal layers PL (i.e., projections corresponding to writing electrodes) having a necessary thickness are formed by plating in the holes of the photoresist PR (see FIG. 33H). By removing the photoresist PR, a writing head 3 having, on a film-shaped substrate 3*a,* the wiring portions 9 and writing electrodes 3*b* that project from the respective wiring portions 9 is obtained (see FIGS. 33I and 33J).

FIGS. 34A–34I illustrate a first modification of the above manufacturing method. Steps of FIGS. 34A–34E are the same as in the above manufacturing method. After the formation of the wiring portions 9, photoresist layers PR are formed in regions where to form projections corresponding to writing electrodes (see FIG. 34F). Portions of the metal foil Cu that are not covered with the resist layers PR and have a predetermined thickness are etched away to form projections, that is, steps (see FIG. 34G). By removing the photoresist layers PR that are located on the projections, a writing head 3 having, on a film-shaped substrate 3*a,* the wiring portions 9 and writing electrodes 3*b* that project from the respective wiring portions 9 is obtained (see FIGS. 34H and 34I).

FIGS. 35A–35J illustrate a second modification of the manufacturing method of FIGS. 33A–33J. First, metal foil Cu is laid on one surface of an insulative member (corresponds to a film-shaped substrate 3*a*) PI and a photoresist PR is applied to the top surface of the metal foil Cu (see FIG. 35A). The photoresist PR is covered with a mask M that is formed with writing electrode patterns, and is then exposed to light (see FIG. 35B). Light-exposed portions of the photoresist PR are etched away to form holes (see FIGS. 35C and 35D), the exposed portions of the metal foil Cu is plated with copper (see FIG. 33E), and the photoresist layers PR are removed (see FIG. 35F). Then, another photoresist PR is applied to the entire surface (see FIG. 35G). The photoresist PR is covered with a mask that is formed with wiring patterns, and is then exposed to light (see FIG. 35H). By etching away unnecessary portions of the wiring portions and removing the photoresist PR, a writing head 3 having, on a film-shaped substrate 3*a,* wiring portions 9 and writing electrodes 3*b* that project from the respective wiring portions 9 is obtained (see FIGS. 35I and 35J).

What is claimed is:

1. A writing head for forming an electrostatic latent image on a cylindrical image carrier, comprising:

a flexible film substrate;

a plurality of writing electrodes, arranged on a first face of the film substrate in a first direction parallel with an axial direction of the image carrier, the writing electrodes adapted to be abutted against an outer periphery of the image carrier to provide electric charges thereto;

a first wiring member, arranged on the first face of the film substrate to supply signals from a first electrode driver to a first electrode group in the writing electrodes; and a second wiring member, arranged on a second face of the film substrate to supply signals from a second electrode driver to a second electrode group in the writing electrodes;

wherein the film substrate is formed with at least one through hole through which the second wiring member extends to the second electrode group.

2. The writing head as set forth in claim 1, wherein the writing electrodes are arranged so as to form a plurality of arrays which are arranged in a second direction perpendicular to the first direction.

3. The writing head as set forth in claim 2, wherein the writing electrodes are arranged such that writing electrodes in adjacent arrays forms a zigzag arrangement with regard to the first direction.

4. The writing head as set forth in claim 2, wherein the writing electrodes are arrayed with regard to both of the first direction and the second direction.

5. The writing head as set forth in claim 1, wherein the film substrate is integrally formed with a reinforcement member which provides a reinforcement for the film substrate in a second direction perpendicular to the first direction.

6. The writing head as set forth in claim 5, wherein the reinforcement member extends in the first direction so as to support at least a region where the writing electrodes are arranged.

7. The writing head as set forth in claim 6, wherein:

the writing electrodes are arranged so as to form a plurality of arrays which are arranged in the second direction; and the reinforcement member extends in the second direction so as to support at least a region where the arrays of the writing electrodes are arranged.

8. The writing head as set forth in claim 5, wherein the reinforcement member extends so as to avoid a portion where each of the writing electrodes is disposed.

9. An image forming apparatus for forming a visible image from the electrostatic latent image formed by the wiring head as set forth in claim 1.

10. A writing head for forming an electrostatic latent image on a cylindrical image carrier, comprising:

a flexible film substrate;

a plurality of writing electrodes, arranged on a first face of the film substrate in a first direction parallel with an axial direction of the image carrier, the writing electrodes adapted to be abutted against an outer periphery of the image carrier to provide electric charges thereto;

a first wiring member, arranged on the first face of the film substrate to supply signals from a first electrode driver to a first electrode group in the writing electrodes; and a second wiring member, arranged on a second face of the film substrate to supply signals from a second electrode driver to a second electrode group in the writing electrodes, wherein:

the film substrate comprises a first layer forming the first face and a second layer forming the second face; and the wiring head further comprises a third wiring member, arranged between the first layer and the second layer to supply signals from a third electrode driver to a third electrode group in the writing electrode.

11. A writing head for forming an electrostatic latent image on a cylindrical image carrier, comprising:

a flexible film substrate;

a plurality of writing electrodes, arranged on a first face of the film substrate in a first direction parallel with an axial direction of the image carrier, the writing electrodes adapted to be abutted against an outer periphery of the image carrier to provide electric charges thereto;

a wiring member, arranged on the first face of the film substrate to supply signals from an electrode driver to the writing electrodes; and a reinforcement member, integrally formed with the film substrate to provide a reinforcement for the film substrate in a second direction perpendicular to the first direction.

12. The writing head as set forth in claim 11, wherein the reinforcement member extends in the first direction so as to support at least a region where the writing electrodes are arranged.

13. The writing head as set forth in claim 12, wherein:

the writing electrodes are arranged so as to form a plurality of arrays which are arranged in the second direction; and the reinforcement member extends in the second direction so as to support at least a region where the arrays of the writing electrodes are arranged.

14. The writing head as set forth in claim 11, wherein the reinforcement member extends so as to avoid a portion where each of the writing electrodes is disposed.

15. The writing head as set forth in claim 11, wherein the reinforcement member is formed on a second face of the film substrate.

16. An image forming apparatus for forming a visible image from the electrostatic latent image formed by the wiring head as set forth in claim 11.

* * * * *